US009604488B2

(12) United States Patent
Sakata

(10) Patent No.: US 9,604,488 B2
(45) Date of Patent: Mar. 28, 2017

(54) PRINTING SYSTEM WITH CREASING CONTROL, CONTROL METHOD THEREOF, CONTROL APPARATUS, AND NON-TRANSITORY COMPUTER-READABLE STORAGE MEDIUM

(71) Applicant: CANON KABUSHIKI KAISHA, Tokyo (JP)

(72) Inventor: Munetaka Sakata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 14/614,438

(22) Filed: Feb. 5, 2015

(65) Prior Publication Data

US 2015/0239276 A1 Aug. 27, 2015

(30) Foreign Application Priority Data

Feb. 25, 2014 (JP) ..... 2014-034711

(51) Int. Cl.
*B42C 19/00* (2006.01)
*B42C 13/00* (2006.01)
*G03G 15/00* (2006.01)

(52) U.S. Cl.
CPC ..... *B42C 19/00* (2013.01); *B42C 13/003* (2013.01); *G03G 15/6544* (2013.01); *G03G 2215/00877* (2013.01); *G03G 2215/00936* (2013.01)

(58) Field of Classification Search
CPC ..... B42C 19/00; B42C 13/003; B42C 7/005; G03G 15/6544; G03G 15/6582; B65H 43/00; B65H 37/06; B65H 45/30
USPC ..... 270/52.18, 58.05; 412/3, 17, 18, 21, 22
See application file for complete search history.

(56) References Cited

U.S. PATENT DOCUMENTS 6,364,590 B1 * 4/2002 Gayoso ..... B42C 7/005 270/52.08
6,394,729 B2 * 5/2002 Welch ..... B42F 13/0013 281/29
6,460,843 B1 * 10/2002 Dim ..... B42C 11/04 270/58.07
7,918,775 B2 * 4/2011 Pohlmann ..... B31F 1/0012 493/396
8,128,331 B2 * 3/2012 Lanman ..... B42C 7/005 412/17
8,316,749 B2 * 11/2012 Rimai ..... B26D 1/08 412/16
8,419,003 B2 4/2013 Kojima et al.
8,613,436 B2 * 12/2013 Tas ..... B42C 7/005 270/52.17

(Continued)

FOREIGN PATENT DOCUMENTS

JP 2012-126472 A 7/2012

OTHER PUBLICATIONS

Munetaka Sakata, U.S. Appl. No. 14/635,256, filed Mar. 2, 2015.

*Primary Examiner* — Patrick Mackey
(74) *Attorney, Agent, or Firm* — Fitzpatrick, Cella, Harper & Scinto

(57) ABSTRACT

A printing system comprises: a printing unit configured to print an image on a sheet; and a control unit configured to control to perform creasing at a first pressure at a portion, corresponding to an edge of a spine cover, of the sheet on which the printing unit has printed the image, and perform creasing at a second pressure different from the first pressure at a portion of the sheet that corresponds to a hinge.

8 Claims, 24 Drawing Sheets

(56) References Cited

U.S. PATENT DOCUMENTS

| | | | | |
|---|---|---|---|---|
| 8,974,360 | B2 * | 3/2015 | Musha | B31F 1/10 270/58.07 |
| 2014/0255124 | A1 * | 9/2014 | Takemasa | B42C 19/02 412/4 |
| 2016/0090265 | A1 * | 3/2016 | Tsutsumi | B65H 45/30 428/174 |

* cited by examiner

FIG. 11

1600

| 1601 MEDIUM ID | 1602 MEDIUM TYPE | 1603 CREASING PRESSURE FOR HINGE | 1604 CREASING PRESSURE FOR SPINE EDGE |
|---|---|---|---|
| 1 | THICK PAPER 1 | 140Kgf | 100Kfg |
| 2 | THICK PAPER 2 | 130Kgf | 90Kfg |
| 3 | PLAIN PAPER 1 | 120Kgf | 80Kfg |

FIG. 14

JOB SETTINGS ☒

GENERAL | JOB INFORMATION | MEDIUM | LAYOUT | FINISHING | CREASE

CREASE FOR HINGE AT TIME OF BOOKBINDING 1901

○ ON ● OFF

OFFSET POSITION FROM SPINE EDGE AT TIME OF BOOKBINDING 1902

15.0 mm

CREASE SETTING FOR EACH PAGE 1903

| PAGE NUMBER | | CREASE 1 | CREASE 2 | CREASE 3 | CREASE 4 |
|---|---|---|---|---|---|
| 1 | POSITION | 200mm | 210mm | 230mm | 240mm |
| | PURPOSE | HINGE | SPINE EDGE | SPINE EDGE | HINGE |
| | | | | | |
| | | | | | |

PRINT 1904 | OK 1905 | CANCEL 1906

PRINTING SYSTEM WITH CREASING CONTROL, CONTROL METHOD THEREOF, CONTROL APPARATUS, AND NON-TRANSITORY COMPUTER-READABLE STORAGE MEDIUM

BACKGROUND OF THE INVENTION

Field of the Invention

The present invention relates to a printing system, a control method thereof, a control apparatus, and a non-transitory computer-readable storage medium and, more particularly, to a method of making a crease at a pressure corresponding to the creasing purpose when performing creasing.

Description of the Related Art

Recently, it is becoming popular to perform crease processing on a printed material bound by case binding or the like, or a printing sheet to undergo fold processing (to be referred to as a "medium" hereinafter) by using an image forming apparatus such as a digital multi-function peripheral. Creasing is processing of making a crease on a medium before performing fold processing. For example, in case binding, creases are made at the edges of a case binding spine so that the folds at the edges of the spine can look fine, improving the quality of the bound printed material. A crease made at a fold position will be called a "crease for a spine edge (crease for a fold)".

Creasing is also used to prompt the user to make a crease in advance at a position where a fold is to be made. For example, case binding often uses a thick medium as a cover. By making a crease on a cover in advance, the user can easily open the cover. When a cover and inner sheets are glued in case binding, a force is applied to the gluing position at the time of opening the cover, and the cover may readily come unstuck. To prevent this, a crease is made at a location spaced apart from the gluing position so that no force is applied to the gluing position even when the user opens the cover. A crease made at a position where the user is requested to make a fold will be called a "crease for a hinge".

Although the "crease for a spine edge (crease for a fold)" and the "crease for a hinge" are made by crease processing that is performed on one medium, an appropriate pressure at which a creasing blade is pressed when forming each crease is different. For example, when a sheet having a grammage of 250 gsm to 300 gsm is used as a case binding cover, it is desirable to make a fold at a high pressure so that the user can easily fold back the cover. In this case, the pressure for the "crease for a hinge" is preferably about 140 Kgf. To the contrary, for the "crease for a spine edge (crease for a fold)", a crease is made at a fold position in advance before fold processing, improving the fold quality. At this time, if a fold for the "crease for a spine edge (crease for a fold)" is made at the same pressure as that for the "crease for a hinge", a creasing trace remains remarkable, degrading the fold quality. To prevent this, the pressure for the "crease for a spine edge (crease for a fold)" is preferably about 70 to 120 Kgf, which is lower than the pressure for the "crease for a hinge".

In a method disclosed in Japanese Patent Laid-Open No. 2012-126472, a crease target medium is creased at a pressure force corresponding to the medium by adjusting, based on sheet information of the target medium, the pressure force of a driving unit that performs crease processing. The method disclosed in Japanese Patent Laid-Open No. 2012-126472 makes a crease based on sheet information of a medium and can perform crease processing at a pressure corresponding to the medium.

In Japanese Patent Laid-Open No. 2012-126472, crease processing is performed at the same pressure for the same medium. Hence, when a single medium is creased a plurality of times, the pressure cannot be controlled in accordance with creasing purposes such as the "crease for a spine edge (crease for a fold)" and the "crease for a hinge".

The present invention has been made to solve the above-described problems, and provides a method capable of changing the creasing pressure even for a single medium in accordance with each creasing purpose by executing creasing at a pressure corresponding to the creasing purpose.

SUMMARY OF THE INVENTION

According to one aspect of the present invention, there is provided a printing system comprising: a printing unit configured to print an image on a sheet; and a control unit configured to control to perform creasing at a first pressure at a portion, corresponding to an edge of a spine cover, of the sheet on which the printing unit has printed the image, and perform creasing at a second pressure different from the first pressure at a portion of the sheet that corresponds to a hinge.

According to another aspect of the present invention, there is provided a printing system comprising: a printing unit configured to print an image on a sheet; and a control unit configured to control to perform creasing at a first pressure at a portion, corresponding to an edge of a spine cover, of the sheet on which the printing unit has printed the image, and perform creasing at a second pressure larger than the first pressure at a portion of the sheet that corresponds to a hinge.

According to another aspect of the present invention, there is provided a control apparatus comprising: a first control unit configured to control to perform creasing at a first pressure at a portion of a sheet that corresponds to an edge of a spine cover, and a second control unit configured to control to perform creasing at a second pressure different from the first pressure at a portion of the sheet that corresponds to a hinge.

According to another aspect of the present invention, there is provided a printing system control method comprising: printing an image on a sheet; and controlling to perform creasing at a first pressure at a portion, corresponding to an edge of a spine cover, of the sheet on which the image has been printed in the printing step, and perform creasing at a second pressure different from the first pressure at a portion of the sheet that corresponds to a hinge.

According to another aspect of the present invention, there is provided a non-transitory computer-readable storage medium storing a program for causing a computer to execute a printing system control method, the printing system control method including: printing an image on a sheet; and controlling to perform creasing at a first pressure at a portion, corresponding to an edge of a spine cover, of the sheet on which the image has been printed in the printing step, and perform creasing at a second pressure different from the first pressure at a portion of the sheet that corresponds to a hinge.

According to the present invention, a crease can be made on a single medium in accordance with a purpose.

Further features of the present invention will become apparent from the following description of exemplary embodiments (with reference to the attached drawings).

BRIEF DESCRIPTION OF THE DRAWINGS

FIG. 11 is a table showing an example of the arrangement of a creasing pressure management table;

FIG. 14 is a view showing an example of a job setting window (crease) according to the second embodiment;

DESCRIPTION OF THE EMBODIMENTS

Embodiments of the present invention will now be described with reference to the accompanying drawings. Note that the following embodiments are not intended to limit an invention defined by the scope of the appended claims.

[System Arrangement]

An example of the arrangement of an image forming system according to the embodiment will be explained with reference to the accompanying drawings.

Figure 1A:
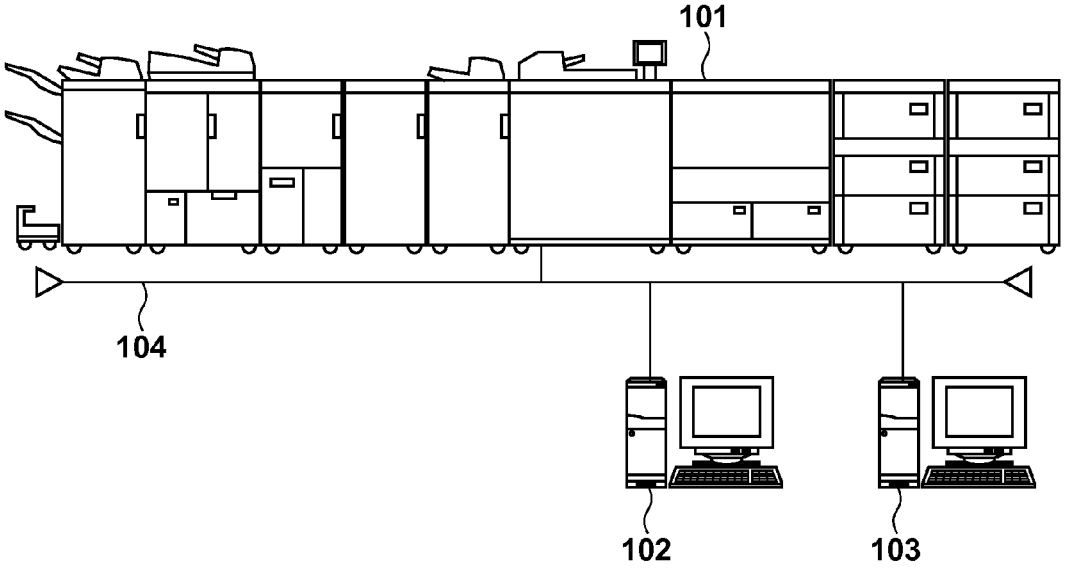
FIGS. 1A and 1B are views respectively showing an example of the arrangements of a system and image forming apparatus.

The image forming system shown in FIG. 1A includes an image forming apparatus 101, an image processing apparatus 102, an information processing apparatus 103, and a network 104. The information processing apparatus 103 is an apparatus that is used by an operator to perform processing such as print job setting. The image processing apparatus 102 performs processing including generation of a print job, job management, RIP (Raster Image Processing), and imposition, and performs printing by using the image forming apparatus 101. The network 104 connects the image forming apparatus 101, the image processing apparatus 102, and the information processing apparatus 103 so that they can communicate with each other.

Figure 1B:
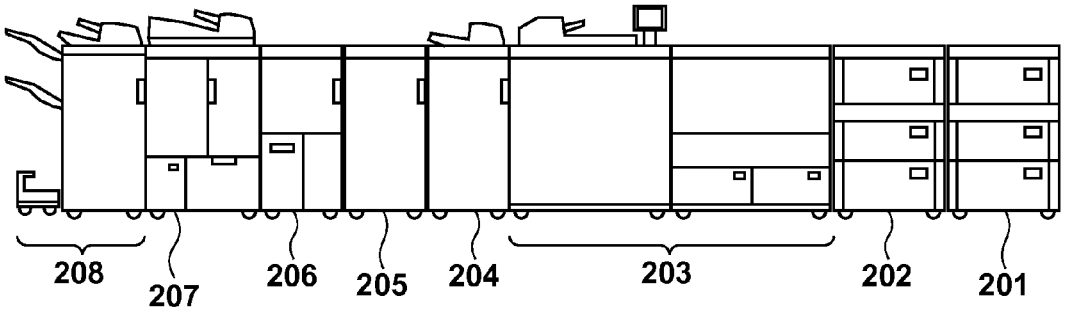

FIG. 1B is a view showing an example of the arrangement of the image forming apparatus 101. The image forming apparatus 101 is constituted by an external feeding apparatus 201, an external feeding apparatus 202, an image forming apparatus main body 203, an inserter apparatus 204, a creaser apparatus 205, a sheet folding apparatus 206, a case binding apparatus 207, and a finisher apparatus 208.

The external feeding apparatuses 201 and 202 provide a large volume of media to the image forming apparatus main body 203. The image forming apparatus main body 203 is a printing apparatus, and prints on media fed from the external feeding apparatuses 201 and 202 and a feeding tray accessory to the image forming apparatus main body 203. The inserter apparatus 204 conveys a medium to the creaser apparatus 205, the sheet folding apparatus 206, the case binding apparatus 207, and the finisher apparatus 208 without the mediacy of the image forming apparatus main body 203. For example, the inserter apparatus 204 is used when a product such as a case-bound product is formed using, for example, pre-printed sheets having undergone printing once by the image forming apparatus main body 203. The creaser apparatus 205 creases a medium. The sheet folding apparatus 206 performs fold forming processing such as Z-folding on a medium. The folding method is not particularly limited. The case binding apparatus 207 is an apparatus for generating a case-bound product. The finisher apparatus 208 performs finishing processing including punching and stapling, and generates a saddle-stitched product.

Figure 2A:
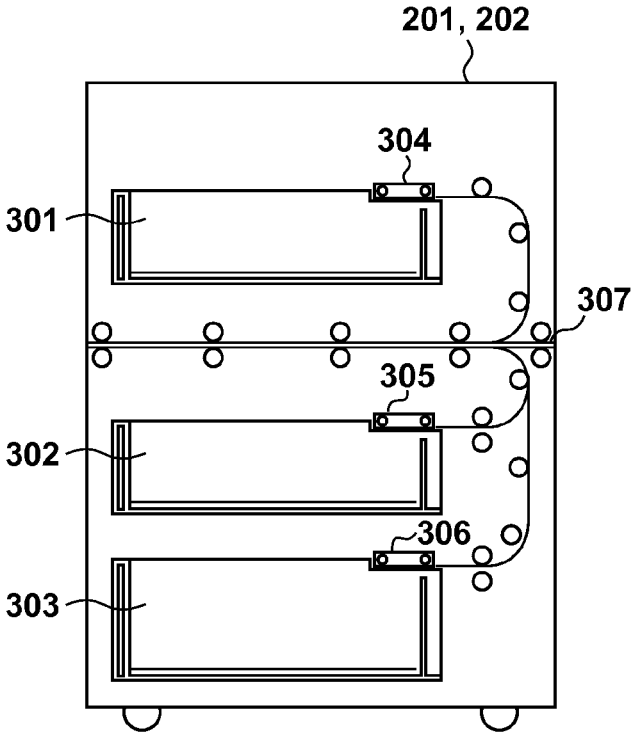
FIGS. 2A and 2B are sectional views respectively showing an external feeding apparatus and an image forming apparatus main body.

FIG. 2A is a sectional view showing the external feeding apparatus 201 or 202. A straight path 307 is a path for conveying downstream media conveyed from feeding trays 301, 302, and 303 and an apparatus connected on the upstream side. In this embodiment, the external feeding apparatus 201 is arranged on the upstream side of the external feeding apparatus 202, and the image forming apparatus main body 203 is arranged on the downstream side. The external feeding apparatus 202 conveys media stacked on the feeding trays 301, 302, and 303, and media conveyed from the external feeding apparatus 201 to the image forming apparatus main body 203 through the straight path 307.

The feeding trays 301, 302, and 303 are trays for feeding a medium. By lifting up the lower portions of the feeding trays using lift-up motors (not shown), fed media can be brought into contact with feeding motors 304, 305, and 306. This mechanism enables feeding regardless of the amount of media. The feeding motors 304, 305, and 306 are motors that pick up media stacked on the feeding trays 301, 302, and 303 one by one, respectively. Media stacked on the feeding trays 301, 302, and 303 are supplied to conveyance paths by the feeding motors 304, 305, and 306, and conveyed to the straight path 307.

Figure 2B:
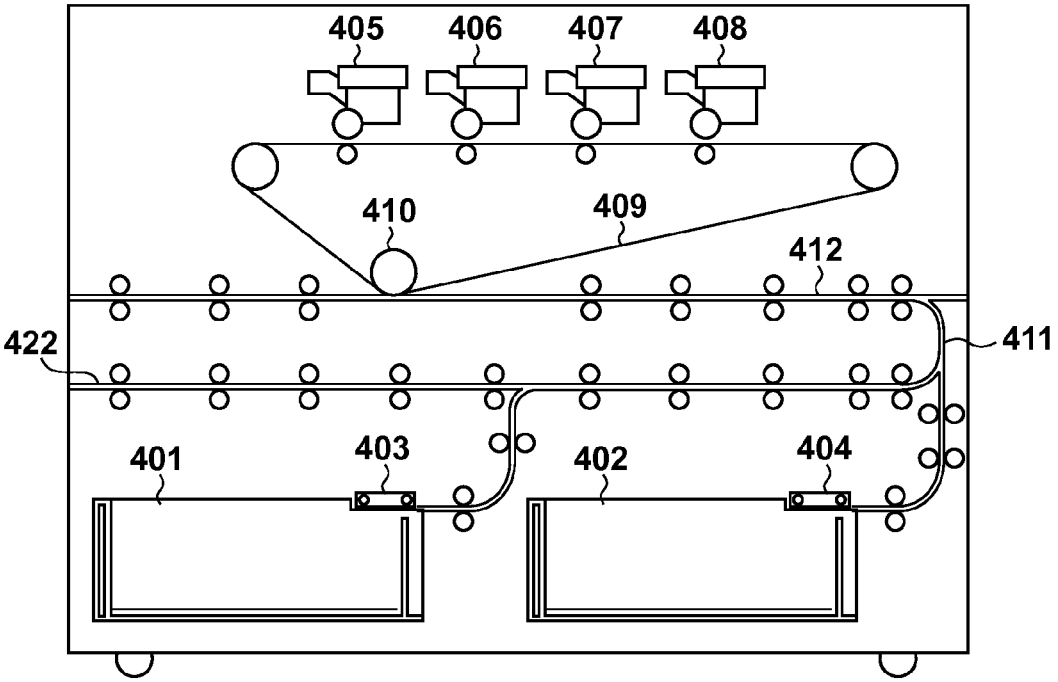
Figure 3A:
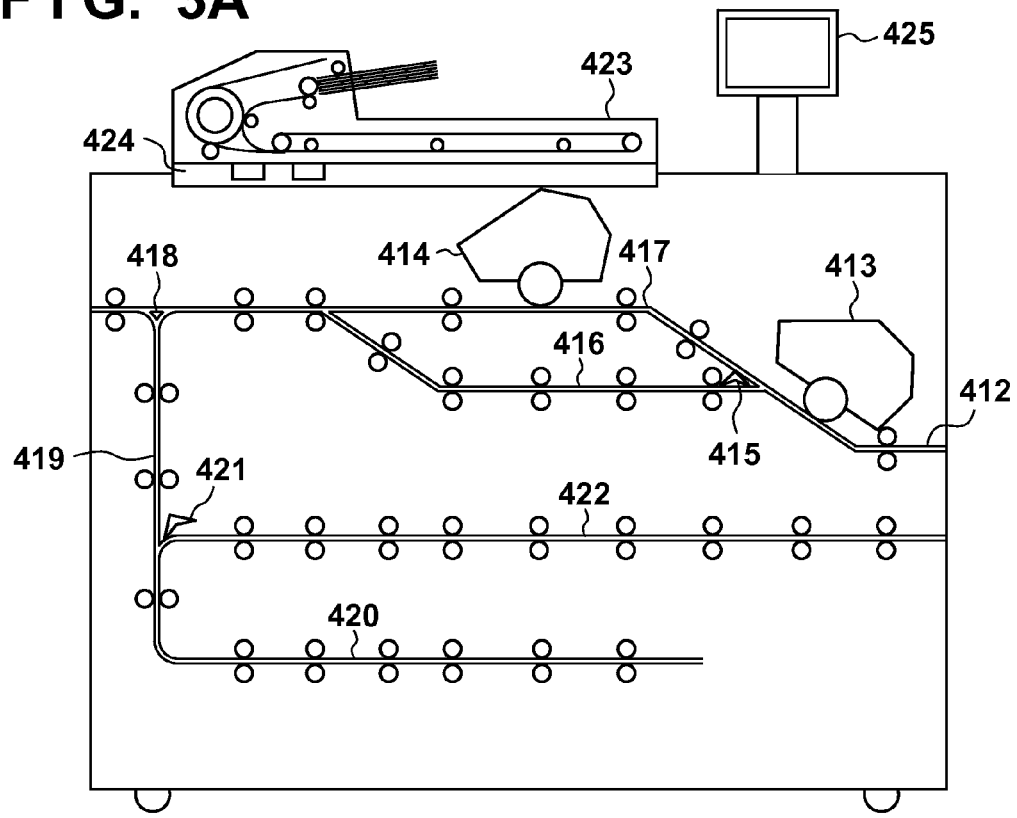
FIGS. 3A and 3B are sectional views respectively showing the image forming apparatus main body and an inserter.

FIGS. 2B and 3A are sectional views showing the image forming apparatus main body 203. FIG. 2B shows the arrangement of the upstream side of the image forming apparatus main body 203. FIG. 3A shows the arrangement of the downstream side of the image forming apparatus main body 203. Here, the upstream side is a side on which the image forming apparatus main body 203 is connected to the external feeding apparatus 202, and the downstream side is a side on which it is connected to the inserter apparatus 204.

Feeding trays 401 and 402 are trays for feeding a medium. By lifting up the lower portions of the feeding trays using lift-up motors (not shown), fed media can be brought into contact with feeding motors 403 and 404. This mechanism enables feeding regardless of the amount of media. The feeding motors 403 and 404 are motors that pick up media stacked on the feeding trays 401 and 402 one by one, respectively. Media stacked on the feeding trays 401 and 402 are supplied to conveyance paths by the feeding motors 403 and 404, and conveyed to a conveyance path 411. A conveyance path 412 is a path for conveying a medium to a secondary transfer position 410. The conveyance path 412 is connected to the straight path of the external feeding apparatus 202. A medium conveyed from the conveyance path 411 and a medium conveyed from the straight path 307 of the external feeding apparatus 202 are conveyed through the conveyance path 412.

Developing units 405, 406, 407, and 408 are developing units for forming an image, and are constituted by stations of four Y, M, C, and K colors, respectively. Images formed by the developing units 405, 406, 407, and 408 are primarily transferred onto an intermediate transfer belt 409 that rotates clockwise in FIG. 2B. The resultant image is transferred at the secondary transfer position 410 onto a medium conveyed to the conveyance path 412.

The medium on which the image has been transferred is conveyed to a first fixing unit 413 through the conveyance path 412 on the downstream side of the image forming apparatus main body 203 shown in FIG. 3A. The first fixing unit 413 fixes the transferred image to the medium by heating and pressing the medium on which the image has been transferred.

A flapper 415 distributes a medium having passed through the first fixing unit 413 to a conveyance path 416 or a conveyance path 417. The flapper 415 is constituted to be swingable about a swing shaft, and regulates the conveyance direction of a medium. When the flapper 415 is swung clockwise in FIG. 3A, a medium is conveyed to the conveyance path 417. When the flapper 415 is swung counterclockwise in FIG. 3A, a medium is conveyed to the conveyance path 416. Either the conveyance path 416 or 417 to which a medium having passed through the first fixing unit 413 is conveyed is decided depending on conditions such as the medium type (for example, grammage). If it is determined that an image needs to be fixed again, the medium is conveyed to the conveyance path 417. If it is determined that an image need not be fixed again, the medium is conveyed to the conveyance path 416. A second fixing unit 414 heats and presses a medium conveyed to the conveyance path 417.

A discharge flapper 418 conveys, to the inserter apparatus 204 or a conveyance path 419, a medium conveyed from the conveyance path 416 or 417. The discharge flapper 418 is constituted to be swingable about a swing shaft, and regulates the conveyance direction of a medium. When the discharge flapper 418 is swung clockwise in FIG. 3A, a medium is conveyed to the inserter apparatus 204. When the discharge flapper 418 is swung counterclockwise in FIG. 3A, a medium is conveyed to the conveyance path 419.

A medium conveyed to the conveyance path 419 is conveyed to a reversing path 420. The conveyance direction of the medium is changed by 180° by switchback processing. A flapper 421 is constituted to be swingable about a swing shaft, and regulates the conveyance direction of a medium. When the flapper 421 is swung clockwise in FIG. 3A, a medium conveyed from the reversing path 420 is conveyed to a conveyance path 422. The conveyance path 422 communicates with the conveyance path 411 on the upstream side of the image forming apparatus main body 203 shown in FIG. 2B. Since the medium is reversed on the reversing path 420, the printing surface of the medium in passing through the first fixing unit 413 and the second fixing unit 414 is turned over. With this mechanism, the image forming apparatus main body 203 executes double-sided printing.

When the flapper 421 is swung counterclockwise in FIG. 3A, a medium passes through the conveyance path 419. The discharge flapper 418 is then swung counterclockwise in FIG. 3A, and the medium is conveyed to the inserter apparatus 204. Since the medium has been reversed on the reversing path 420, the medium can be conveyed to the inserter apparatus 204 with the fixed image facing down. Note that conveyance of a medium to the inserter apparatus 204 with a fixed image facing up can be implemented by not using the reversing path 420.

An ADF (Auto Document Feeder) 423 is a document feeder for separating a document bundle set on the stacking surface of a document tray sequentially in the page order from a document of the first page, and scanning the document by a scanner 424. The scanner 424 irradiates, with a light source (not shown), a document conveyed from the ADF 423, and reads the document image by using a CCD (not shown). The read document image undergoes image processing, and a copy operation is executed using the developing units 405 to 408 shown in FIG. 2B.

An operation panel 425 is an operation panel accessory to the image forming apparatus main body 203, and is used to make settings in the image forming apparatus 101 and start the copy operation.

Figure 3B:
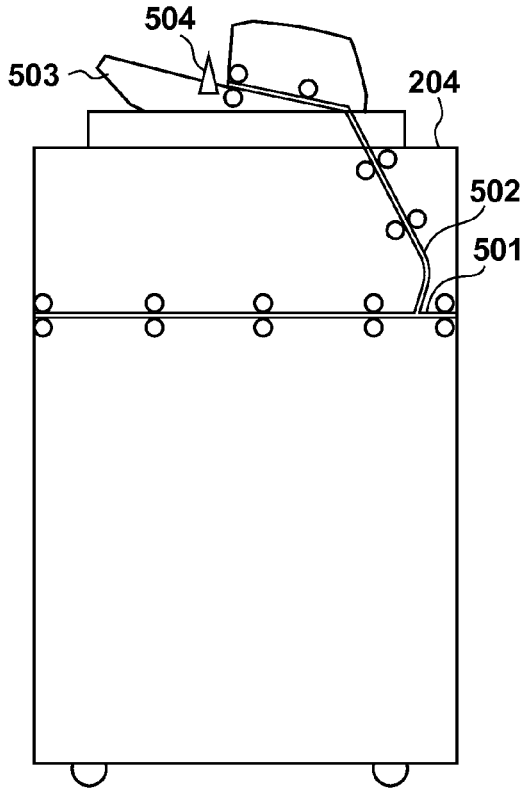

FIG. 3B is a sectional view showing the inserter apparatus 204. A straight path 501 is a path for conveying downstream a medium conveyed from the upstream side. In this embodiment, the inserter apparatus 204 conveys, to the creaser apparatus 205 through the straight path 501, a medium received from the image forming apparatus main body 203.

A conveyance path 502 is a conveyance path for conveying, to the straight path 501, a medium fed to an inserter tray 503. The inserter tray 503 is a tray for feeding, to the creaser apparatus 205, the sheet folding apparatus 206, the case binding apparatus 207, or the finisher apparatus 208, a medium not to undergo print processing by the image forming apparatus main body 203. A sheet detection sensor 504 is a sensor that detects whether a medium has been fed to the inserter tray 503. The inserter apparatus 204 includes a conveyance roller, and conveys, from the conveyance path 502 to the straight path 501, a medium fed to the inserter tray 503. The medium is conveyed to the downstream side through the straight path 501.

Figure 4:
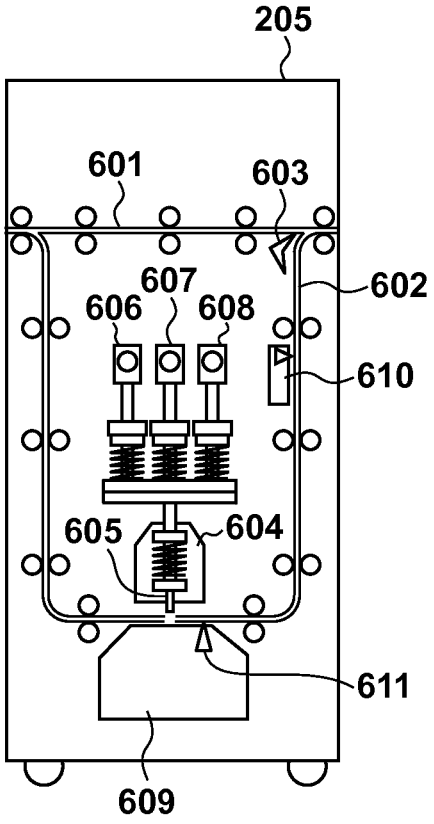
FIG. 4 is a sectional view showing a creaser apparatus according to the first embodiment.

FIG. 4 is a sectional view showing the creaser apparatus 205. A straight path 601 is a path for conveying downstream a medium conveyed from the upstream side. In this embodiment, the creaser apparatus 205 conveys, to the sheet folding apparatus 206 through the straight path 601, a medium received from the inserter apparatus 204.

A conveyance path 602 is a conveyance path for conveying a medium to undergo crease processing. A flapper 603 distributes a medium conveyed from the inserter apparatus 204 to the straight path 601 or the conveyance path 602. The flapper 603 is constituted to be swingable about a swing shaft, and regulates the conveyance direction of a medium. When the flapper 603 is swung clockwise in FIG. 4, a medium is conveyed to the straight path 601. When the flapper 603 is swung counterclockwise in FIG. 4, a medium is conveyed to the conveyance path 602.

A creasing die 604 is a die for performing crease processing on a medium, and includes a creasing blade 605 for performing creasing. Note that the creasing die 604 is detachable from the creaser apparatus 205, and a sensor (not shown) can detect whether the creasing die 604 is attached in the creaser apparatus 205. Further, the sensor (not shown) can uniquely recognize the type of attached die. Pressure devices 606, 607, and 608 are devices for applying a pressure to the creasing die 604. A base 609 is a base for receiving the creasing blade 605. A conveyance speed control unit 610 controls the conveyance speed of a medium to a predetermined speed, and incorporates a sensor (not shown) for detecting the conveyance speed of a medium. A detection sensor 611 is a sensor for detecting the leading end of a conveyed medium.

Creasing of a medium by the creaser apparatus 205 is implemented by performing the following operation. First, based on the detection result of the sensor (not shown) for detecting the conveyance speed of a medium, the conveyance speed control unit 610 accelerates or decelerates a medium so that the conveyance speed of the medium passing through the conveyance path 602 becomes a predetermined speed. When the detection sensor 611 detects the leading end of the medium conveyed at the predetermined speed, the pressure devices 606 to 608 apply a pressure to the creasing die 604 downward from above it in FIG. 4. Note that only an arbitrary one of the pressure devices 606 to 608 can operate, or a plurality of devices can operate synchronously. The pressure devices 606 to 608 can control a pressure to be applied to the creasing die 604.

The pressure applied to the creasing die 604 from the pressure devices 606 to 608 is transferred to the creasing blade 605. The creasing blade 605 moves down from above a medium in FIG. 4, and the creasing blade 605 and the base 609 sandwich the medium, thereby implementing creasing. Note that the creaser apparatus 205 can make a crease at an arbitrary position of a medium in the conveyance direction. More specifically, creasing is implemented by performing the following control.

The conveyance speed control unit 610 controls a medium conveyed through the conveyance path 502 to a predetermined conveyance speed. The timing to perform creasing by the creasing blade 605 can be calculated by dividing, by a predetermined conveyance speed, a value obtained by adding a crease position (distance from the leading end of a medium) to the distance between the detection sensor 611 and the creasing blade 605. That is, the pressure devices 606 to 608 are driven so that the creasing blade 605 contacts a medium at the calculated timing based on the timing when the detection sensor 611 detected the leading end of the medium.

Figure 5A:
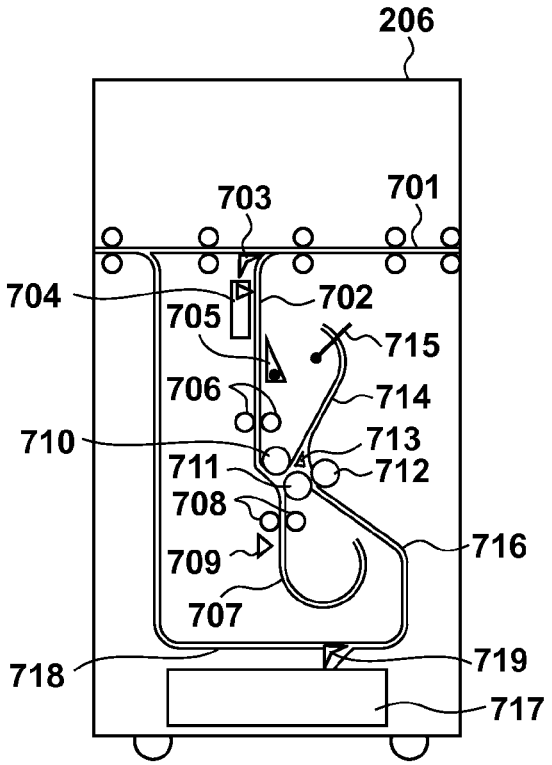
FIGS. 5A and 5B are views respectively for explaining the section of a sheet folding apparatus and the formed shape of a medium.

FIG. 5A is a sectional view showing the sheet folding apparatus 206. A straight path 701 is a path for conveying downstream a medium conveyed from the upstream side. In this embodiment, the sheet folding apparatus 206 conveys, to the case binding apparatus 207 through the straight path 701, a medium received from the creaser apparatus 205. A conveyance path 702 is a conveyance path for conveying a medium to undergo fold processing.

A flapper 703 distributes a medium conveyed from the creaser apparatus 205 to the straight path 701 or the conveyance path 702. The flapper 703 is constituted to be swingable about a swing shaft, and regulates the conveyance direction of a medium. When the flapper 703 is swung clockwise in FIG. 5A, a medium is conveyed to the straight path 701. When the flapper 703 is swung counterclockwise in FIG. 5A, a medium is conveyed to the conveyance path 702. A conveyance speed control unit 704 is a unit that controls the conveyance speed of a medium to a predetermined speed, and incorporates a sensor (not shown) for detecting the conveyance speed of a medium.

An abutment stopper 705 is used at the time of forming a C-fold. The abutment stopper 705 can be driven by a motor (not shown). The abutment stopper 705 can rotate counterclockwise from 0° to 90° in FIG. 5A, and move up and down along the conveyance path 702. First, the abutment stopper 705 is kept at a position in FIG. 5A by the rotational motion mechanism, and a medium can be conveyed from top to bottom on the conveyance path 702. Then, the abutment stopper 705 is rotated counterclockwise by 90° and can close the conveyance path 702. That is, the abutment stopper 705 functions as an abutment stopper for a medium conveyed through the conveyance path 702. Further, the vertical motion mechanism along the conveyance path 702 can adjust the length from the abutment stopper 705 to a portion between folding rollers 710 and 711.

A conveyance roller pair 706 is a conveyance roller pair for conveying up or down a medium conveyed through the conveyance path 702. The rotational direction of the conveyance roller pair 706 can be controlled, and can be rotated in a direction in which a medium is pushed from top to bottom. The conveyance roller pair 706 can also be rotated in a direction in which a medium is pushed from bottom to top.

A conveyance path 707 is a conveyance path for drawing a medium at the time of forming a fold. A registration roller pair 708 is a roller pair for temporarily stopping a medium conveyed from the conveyance path 702 to the conveyance path 707. Further, the registration roller pair 708 can convey a temporarily stopped medium in the up or down direction. The rotational direction of the registration roller pair 708 can be controlled, and can be rotated in a direction in which a medium is pushed from top to bottom. The registration roller pair 708 can also be rotated in a direction in which a medium is pushed from bottom to top.

A medium detection sensor 709 is a sensor for detecting the leading end of a medium temporarily stopped by the registration roller pair 708. The folding roller 710, the folding roller 711, and a folding roller 712 are rollers used to form a fold. The folding rollers 710 to 712 are always driven simultaneously. At this time, the folding roller 710 rotates counterclockwise in FIG. 5A, the folding roller 711 rotates clockwise in FIG. 5A, and the folding roller 712 rotates counterclockwise in FIG. 5A.

A leading end press guide 713 is a guide used to form a single fold. The leading end press guide 713 is used to guide, to a conveyance path 716, a medium drawn from the folding rollers 710 and 711 without passing through a conveyance path 714. The leading end press guide 713 can be driven by a motor (not shown). When a medium drawn from the folding roller 711 is not guided to the conveyance path 716, the leading end press guide 713 is retracted from the position in FIG. 5A. More specifically, when the leading end press guide 713 is retracted, the medium drawn from the folding rollers 710 and 711 is drawn to the conveyance path 714.

The conveyance path 714 is a conveyance path for drawing a medium at the time of forming a fold. A portion, close to the top, of the conveyance path 714 in FIG. 5A has an arcuate shape so that the length by which a medium is drawn can be adjusted by an abutment stopper 715. The abutment stopper 715 is an abutment stopper used at the time of forming a Z-fold, a 6-page accordion fold, a double parallel fold, or a C-fold. The abutment stopper 715 can be driven by a motor (not shown) and can rotate along the conveyance path 714. The length by which a medium is drawn to the conveyance path 714 can be adjusted by adjusting the position of the abutment stopper 715.

The conveyance path 716 is a path for conveying a medium having passed through the folding rollers 710 to 712. Fold formation processing on the medium has been completed upon passing through the conveyance path 716. A discharge portion 717 is used to discharge a C-folded or double parallel-folded medium. A conveyance path 718 is used to convey a folded medium to the straight path 701.

A flapper 719 distributes a medium conveyed through the conveyance path 716 to the discharge portion 717 or the conveyance path 718. The flapper 719 is constituted to be swingable about a swing shaft, and regulates the conveyance direction of a medium. When the flapper 719 is swung clockwise in FIG. 5A, a medium is conveyed to the conveyance path 718. When the flapper 719 is swung counterclockwise in FIG. 5A, a medium is discharged to the discharge portion 717.

Figure 5B:
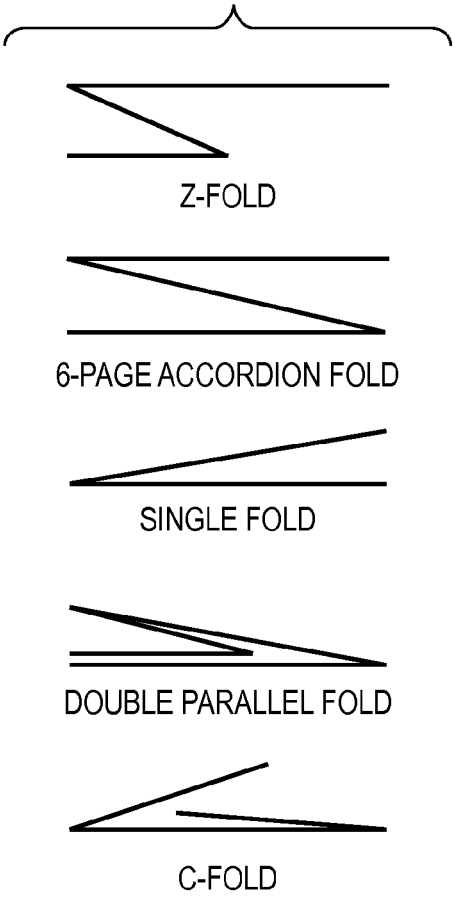

Next, fold formation processing for each shape will be explained. First, FIG. 5B shows the shape of a fold when a medium passes through the conveyance path 718. The sheet folding apparatus 206 conveys a medium to the straight path 701 when forming a Z-fold, a 6-page accordion fold, and a single fold, and discharges a medium to the discharge portion 717 when forming a double parallel fold and a C-fold.

Subsequently, a case in which the sheet folding apparatus 206 forms a Z-fold will be explained. A medium conveyed through the straight path 701 is conveyed to the conveyance path 702 by the flapper 703. The conveyance speed control unit 704 controls the conveyance speed of the medium to a predetermined speed. At this time, the abutment stopper 705 exists at the position in FIG. 5A. Thus, the medium is conveyed through the conveyance path 702 and moves until it is temporarily stopped by the registration roller pair 708. The medium detection sensor 709 detects the leading end position of the medium temporarily stopped by the registration roller pair 708. The medium is then drawn to the conveyance path 707 by the registration roller pair 708. At this time, the length from the leading end of the drawn medium to a portion between the folding rollers 710 and 711 is controlled to be ¼ of the medium length.

When the conveyance roller pair 706 is kept controlled to convey the medium downward while the registration roller pair 708 stops the medium at that position, a loop of the medium is formed between the folding rollers 710 and 711. The folding rollers 710 and 711 draw the looped portion, folding the medium at a ¼ portion from the leading end of the medium.

When forming a Z-fold, the leading end press guide 713 is controlled to be retracted, and the medium is drawn to the conveyance path 714. At this time, the abutment stopper 715 is controlled so that the length up to a portion between the folding rollers 711 and 712 becomes ¼ of the medium length. By the folding rollers 710 and 711, the medium drawn to the conveyance path 714 forms a loop at the center portion of the medium. The folding rollers 711 and 712 draw the looped portion, and the Z-folded medium is conveyed to the conveyance path 716. After that, the flapper 719 is controlled to convey the medium to the conveyance path 718, and the Z-folded medium is conveyed to the straight path 701.

Subsequently, a case in which the sheet folding apparatus 206 forms a 6-page accordion fold will be explained. A process when the sheet folding apparatus 206 forms a 6-page accordion fold is almost the same as that when a Z-fold is formed. A 6-page accordion fold can be formed by setting the length by which a medium is drawn to the conveyance paths 707 and 714, to be ⅓ of the medium length. The 6-page accordion fold formation process is almost the same as the Z-fold formation process, and a description thereof will not be repeated.

Subsequently, a case in which the sheet folding apparatus 206 forms a single fold will be explained. A medium conveyed through the straight path 701 is conveyed to the conveyance path 702 by the flapper 703. The conveyance speed control unit 704 controls the conveyance speed of the medium to a predetermined speed. At this time, the abutment stopper 705 exists at the position in FIG. 5A. Thus, the medium is conveyed through the conveyance path 702 and moves until it is temporarily stopped by the registration roller pair 708. The medium detection sensor 709 detects the leading end position of the medium temporarily stopped by the registration roller pair 708. The medium is then drawn to the conveyance path 707 by the registration roller pair 708. At this time, the length from the leading end of the drawn medium to the portion between the folding rollers 710 and 711 is controlled to be ½ of the medium length.

When the conveyance roller pair 706 is kept controlled to convey the medium downward while the registration roller pair 708 stops the medium at that position, a loop of the medium is formed between the folding rollers 710 and 711. The folding rollers 710 and 711 draw the looped portion, folding the medium at a ½ portion from the leading end of the medium.

When forming a single fold, the leading end press guide 713 exists at the position in FIG. 5A. The medium drawn by the folding rollers 710 and 711 is conveyed to be drawn to the conveyance path 716 by the folding rollers 711 and 712. In this manner, the single-folded medium is conveyed to the conveyance path 716. The flapper 719 is controlled to convey the medium to the conveyance path 718, and the single-folded medium is conveyed to the straight path 701.

Subsequently, a case in which the sheet folding apparatus 206 forms a double parallel fold will be explained. A medium conveyed through the straight path 701 is conveyed to the conveyance path 702 by the flapper 703. The conveyance speed control unit 704 controls the conveyance speed of the medium to a predetermined speed. At this time, the abutment stopper 705 exists at the position in FIG. 5A. Thus, the medium is conveyed through the conveyance path 702 and moves until it is temporarily stopped by the registration roller pair 708. The medium detection sensor 709 detects the leading end position of the medium temporarily stopped by the registration roller pair 708. The medium is then drawn to the conveyance path 707 by the registration roller pair 708. At this time, the length from the leading end of the drawn medium to the portion between the folding rollers 710 and 711 is controlled to be ½ of the medium length.

When the conveyance roller pair 706 is kept controlled to convey the medium downward while the registration roller pair 708 stops the medium at that position, a loop of the medium is formed between the folding rollers 710 and 711. The folding rollers 710 and 711 draw the looped portion, at a ½ portion from the leading end of the medium.

When forming a double parallel fold, the leading end press guide 713 is controlled to be retracted, and the medium is drawn to the conveyance path 714. At this time, the abutment stopper 715 is controlled so that the length up to the portion between the folding rollers 711 and 712 becomes ¼ of the medium length. By the folding rollers 710 and 711, the medium drawn to the conveyance path 714 forms a loop at the center portion of the medium. The folding rollers 711 and 712 draw the looped portion, and the double parallel-folded medium is conveyed to the conveyance path 716. After that, the flapper 719 is controlled to convey the medium to the discharge portion 717, and the double parallel-folded medium is discharged to the discharge portion 717.

Subsequently, a case in which the sheet folding apparatus 206 forms a C-fold will be explained. A medium conveyed through the straight path 701 is conveyed to the conveyance path 702 by the flapper 703. The conveyance speed control unit 704 controls the conveyance speed of the medium to a predetermined speed. At this time, the abutment stopper 705 exists at the position in FIG. 5A. Thus, the medium is conveyed through the conveyance path 702 and moves until it is temporarily stopped by the registration roller pair 708. The medium detection sensor 709 detects the leading end position of the medium temporarily stopped by the registration roller pair 708. The medium is then drawn to the conveyance path 707 by the registration roller pair 708. At this time, the length from the leading end of the drawn medium to the portion between the folding rollers 710 and 711 is controlled to be equal to or larger than ⅔ of the medium length.

Then, the abutment stopper 705 is controlled counterclockwise in FIG. 5A. Further, the abutment stopper 705 is adjusted so that the length on the conveyance path from the abutment stopper 705 to the portion between the folding rollers 710 and 711 becomes ⅓ of the medium length. After that, the registration roller pair 708 is controlled to convey upward the temporarily stopped medium. The medium abuts against the abutment stopper 705, and a loop of the medium is formed between the folding rollers 710 and 711. The folding rollers 710 and 711 draw the looped portion, folding the medium at a ⅓ portion from the trailing end of the medium.

When forming a C-fold, the leading end press guide 713 is retracted, and the medium is drawn to the conveyance path 714. At this time, the abutment stopper 715 is controlled so that the length up to the portion between the folding rollers 711 and 712 becomes ⅓ of the medium length. By the folding rollers 710 and 711, the medium drawn to the conveyance path 714 forms a loop at the center portion of the medium. The folding rollers 711 and 712 draw the looped portion, and the C-folded medium is conveyed to the conveyance path 716. After that, the flapper 719 is controlled to convey the medium to the discharge portion 717, and the C-folded medium is discharged to the discharge portion 717.

Figure 6A:
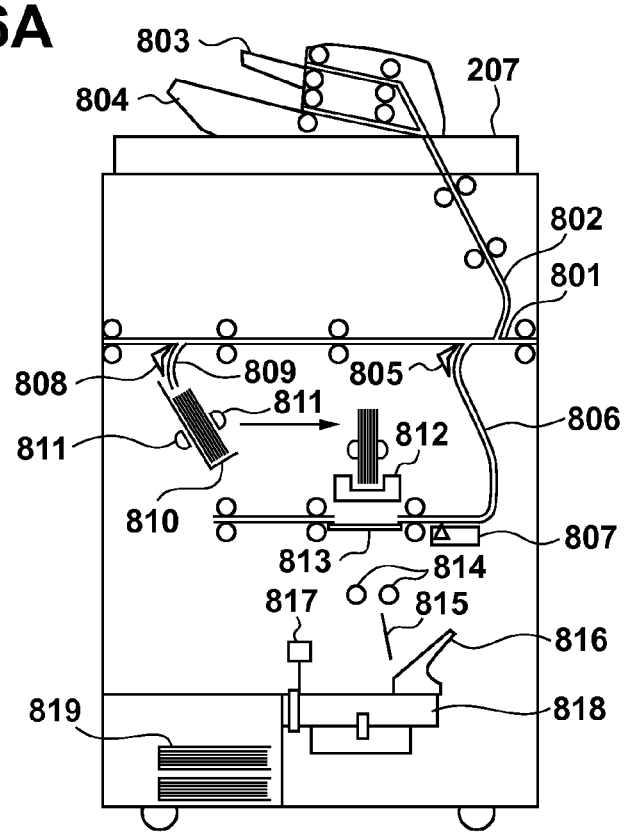
FIGS. 6A and 6B are sectional views respectively showing a case binding apparatus and a finisher apparatus.

FIG. 6A is a sectional view showing the case binding apparatus 207. A straight path 801 is a path for conveying downstream a medium conveyed from the upstream side. In this embodiment, the case binding apparatus 207 conveys, to the finisher apparatus 208 through the straight path 801, a medium received from the sheet folding apparatus 206. A conveyance path 802 is a conveyance path for conveying, to the straight path 801, media fed to inserter trays 803 and 804. The inserter trays 803 and 804 are trays for feeding a printed medium when a case-bound product is generated using printed media.

A flapper 805 distributes media conveyed from the sheet folding apparatus 206 and the inserter trays 803 and 804 to the straight path 801 or a conveyance path 806. The flapper 805 is constituted to be swingable about a swing shaft, and regulates the conveyance direction of a medium. When the flapper 805 is swung clockwise in FIG. 6A, a medium is conveyed to the straight path 801. When the flapper 805 is swung counterclockwise in FIG. 6A, a medium is conveyed to the conveyance path 806. A conveyance speed control unit 807 includes a sensor (not shown) for detecting the leading end of a medium. The conveyance speed control unit 807 has a function of stopping conveyance of a medium after the sensor detects the leading end of the medium and the medium is conveyed by a predetermined distance.

A flapper 808 distributes a medium conveyed from the straight path 801 to the straight path 801 or a conveyance path 809. The flapper 808 is constituted to be swingable about a swing shaft, and regulates the conveyance direction of a medium. When the flapper 808 is swung clockwise in FIG. 6A, a medium is conveyed to the straight path 801. When the flapper 808 is swung counterclockwise in FIG. 6A, a medium is conveyed to the conveyance path 809. The conveyance path 809 is a conveyance path for conveying a medium to a medium stacking unit 810.

The medium stacking unit 810 is a unit for stacking case binding inner sheets. The medium stacking unit 810 has a U shape that is open on the front side, and has a function of moving from the front side to the back side. A gripper pair 811 grips an inner sheet bundle stacked in the medium stacking unit 810, and after a gluing unit 812 glues the inner sheet bundle, conveys the inner sheet bundle to a formation roller pair 814. The gluing unit 812 is a unit that dissolves glue for gluing a case binding inner sheet bundle and a case binding cover. The gluing unit 812 stores the dissolved glue in the unit during the operation of the case binding apparatus 207, and has a function of moving from the front side to the back side.

A gluing table 813 is used when gluing an inner sheet bundle and cover to which the dissolved glue has been attached, and has a function of moving from the front side to the back side. The formation roller pair 814 is used to form the glued inner sheet bundle and cover into the shape of a case-bound product. The formation roller pair 814 rotates a roller pair in a direction in which a medium is pushed from top to bottom. The formation roller pair 814 receives the glued inner sheet bundle and cover from the gripper pair 811, and drops the formed case-bound product to a turntable 818 along a guide 815 with the spine cover side of the case-bound product facing down.

The guide 815 is a guide for dropping the spine cover side of a formed case-bound product to face a widthwise alignment portion 816. The widthwise alignment portion 816 is a device for adjusting the position in order to cut a formed case-bound product by a cutter 817. The cutter 817 is a cutter for cutting the edge, top, and bottom of a formed case-bound product. The turntable 818 has a function of rotating a formed case-bound product, and makes it possible to cut the edge, top, and bottom of a case-bound product by only the cutter 817. A basket portion 819 is a storage place for storing a cut case-bound product.

An operation when generating a case-bound product will be explained in detail below. A medium serving as a case binding cover is conveyed to the conveyance path 806 by the flapper 805. The conveyance speed control unit 807 is controlled to stop the conveyance at a position where the center position of the medium serving as the case binding cover coincides with the center of a case binding spine cover. More specifically, the medium serving as the case binding cover is set on the gluing table 813.

Then, a medium serving as a case binding inner sheet is conveyed to the straight path 801 by the flapper 805, and conveyed to the medium stacking unit 810 through the conveyance path 809 by the flapper 808. When an inner sheet bundle is completed, the gripper pair 811 grips the inner sheet bundle, and the medium stacking unit 810 moves from the front side to the back side. At this time, the gripper pair 811 is positioned in the U-shaped space of the medium stacking unit 810. By moving the medium stacking unit 810 to the back side, the gripper pair 811 can move the inner sheet bundle to the gluing unit 812.

While the gripper pair 811 rotates so that the spine cover direction of the inner sheet bundle faces down, it moves to the gluing unit 812 to perform gluing. Upon completion of gluing, the gripper pair 811 temporarily moves up the inner sheet bundle. Further, the gluing unit 812 is moved from the front side to the back side. Upon completion of the movement of the gluing unit 812, the gripper pair 811 moves down and adheres the inner sheet bundle to the medium serving as the case binding cover set on the gluing table 813. Upon completion of adhesion, the gluing table 813 moves from the front side to the back side. Upon completion of the movement, the gripper pair 811 moves down, and the formation roller pair 814 forms a case-bound product.

Subsequently, the formed case-bound product is pushed down to the formation roller pair 814 along the guide 815, and is set on the turntable 818 with the spine cover side facing the widthwise alignment portion 816. The formed case-bound product laid on the turntable 818 is aligned by the widthwise alignment portion 816, and a portion serving as the edge is cut by the cutter 817. The turntable 818 rotates by 90°, the case-bound product is aligned by the widthwise alignment portion 816, and a portion serving as the top is cut. Further, the turntable 818 rotates by 180°, the case-bound product is aligned by the widthwise alignment portion 816, and a portion serving as the bottom is cut. Finally, the cut case-bound product is pushed to the left in FIG. 6A by the widthwise alignment portion 816, and dropped into the basket portion 819.

Figure 6B:
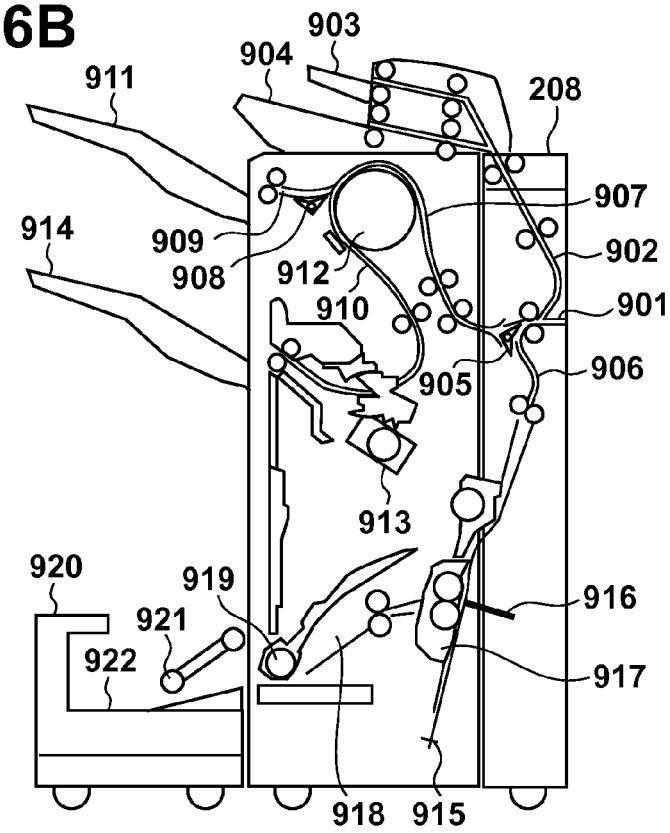

FIG. 6B is a sectional view showing the finisher apparatus 208. A conveyance path 901 is a path for conveying a medium conveyed from the upstream side into the finisher apparatus 208. In this embodiment, the finisher apparatus 208 conveys, into it, a medium received from the case binding apparatus 207. A conveyance path 902 is a conveyance path for conveying, to the conveyance path 901, media fed to inserter trays 903 and 904. The inserter trays 903 and 904 are trays for feeding a printed medium when a punched, stapled, or saddle-stitched product is generated using printed media.

A flapper 905 is constituted to be swingable about a swing shaft, and regulates the conveyance direction of a medium conveyed through the conveyance path 901 or 902. When the flapper 905 is swung counterclockwise in FIG. 6B, a medium is conveyed to a conveyance path 906. When the flapper 905 is swung clockwise in FIG. 6B, a medium is conveyed to a conveyance path 907. A flapper 908 is constituted to be swingable about a swing shaft, and regulates the conveyance direction of a medium conveyed through the conveyance path 907. When the flapper 908 is swung counterclockwise in FIG. 6B, a medium is conveyed to a conveyance path 910. When the flapper 908 is swung clockwise in FIG. 6B, a medium is conveyed to a conveyance path 909.

The conveyance path 909 is a conveyance path for conveying a medium to a sample tray 911. The conveyance path 910 is a conveyance path for conveying a medium to a stacking tray 914. The sample tray 911 is a tray to which a medium having passed through the conveyance path 909 is discharged. A medium conveyed to the conveyance path 910 passes through a puncher 912 and a stapler 913, and is conveyed to the stacking tray 914. The puncher 912 is a device that performs punch processing on a medium passing through the conveyance path 910. The puncher 912 includes a changeable blade (not shown) for two holes, three holes, or the like. By changing the blade, an arbitrary number of holes can be formed in a medium.

The stapler 913 is a device that stacks media passing through the conveyance path 910 and performs staple processing. The stapler 913 includes refillable staples (not shown), and can perform various staple processes such as corner stapling and two-position stapling. The stacking tray 914 is a tray to which a medium having passed through the conveyance path 910 is discharged. The conveyance path 906 is a conveyance path for conveying a medium when performing saddle stitch processing.

A stopper 915 is a stopper for stopping a medium conveyed from the conveyance path 906. The stopper 915 can adjust the length from the stopper 915 to a folding plate 916 by a motor (not shown). In general, the length is set to ½ of the length, in the conveyance direction, of a medium to undergo saddle stitch processing. That is, saddle stitch processing is performed at the center of media to undergo saddle stitch processing.

The folding plate 916 is a device for pushing media stopped by the stopper 915 into a saddle stitcher 917. The saddle stitcher 917 is a device that performs staple processing and fold processing on a medium pushed by the folding plate 916. Media are folded at the center by the operations of the stopper 915 and folding plate 916, and come into the saddle stitcher 917. After the media pass through the saddle stitcher 917, the media having undergone saddle stitch processing are conveyed to a stacking portion 918. The media having undergone saddle stitch processing are discharged from the stacking portion 918 to a saddle tray 920 by an external discharge roller 919. A guide 921 operates to store media having undergone saddle stitch processing and sequentially supply booklets one by one to a saddle stacking portion 922. The saddle stacking portion 922 stores a large volume of media having undergone saddle stitch processing.

[Example of Hardware Arrangement]

Figure 7A:
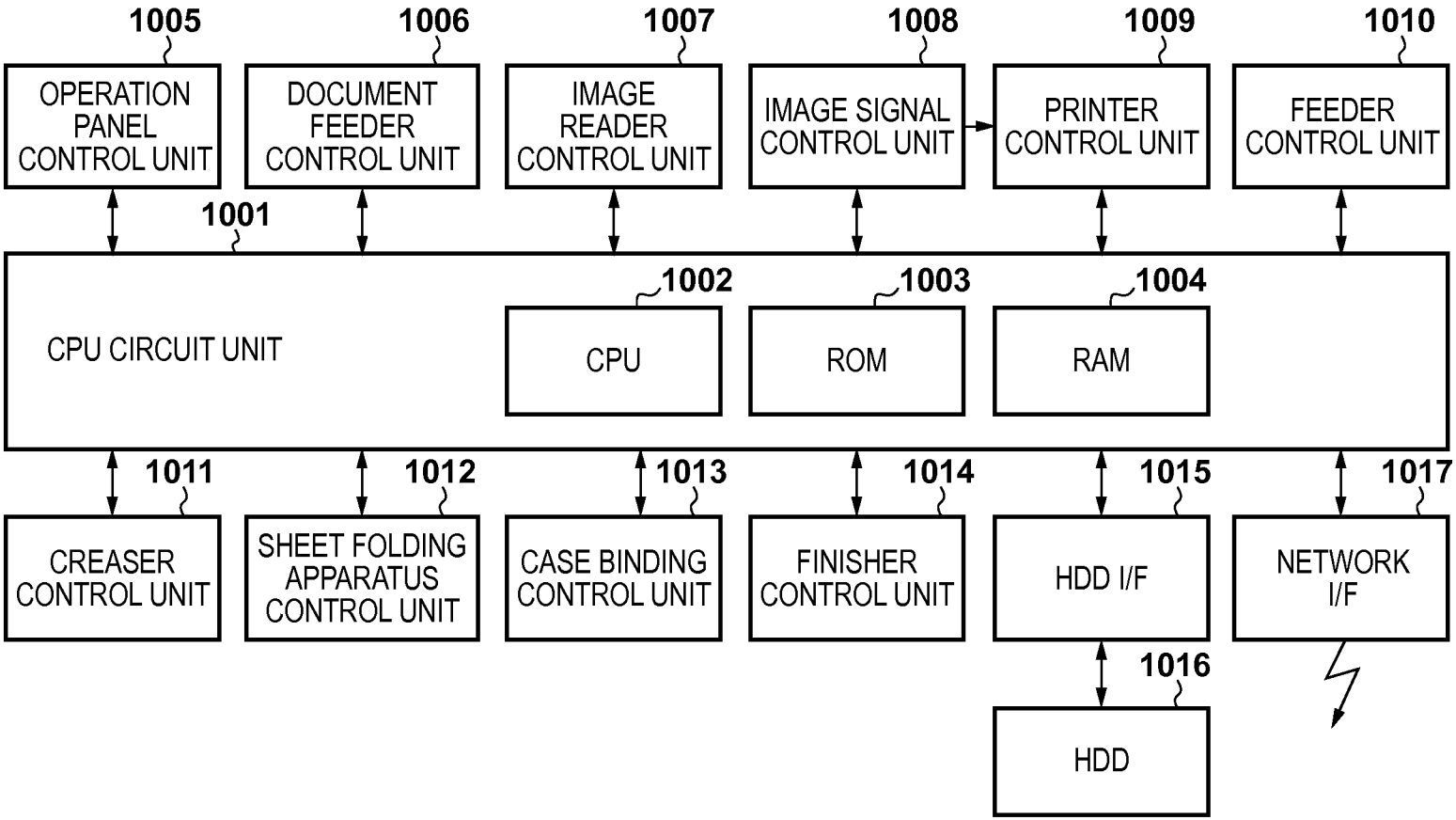
FIGS. 7A, 7B, and 7C are block diagrams respectively showing an example of the hardware arrangements of the image forming apparatus, the creaser apparatus, and an information processing apparatus.

FIG. 7A is a block diagram showing an example of the hardware arrangement of the image forming apparatus 101. A CPU circuit unit 1001 includes a CPU (Central Processing Unit) 1002, and controls the following control units in accordance with programs stored in a ROM (Read Only Memory) 1003 serving as a storage unit. The CPU circuit unit 1001 controls an operation panel control unit 1005, a document feeder control unit 1006, an image reader control unit 1007, an image signal control unit 1008, a printer control unit 1009, and a feeder control unit 1010, which are control units regarding printing. The CPU circuit unit 1001 controls a creaser control unit 1011, a sheet folding apparatus control unit 1012, a case binding control unit 1013, and a finisher control unit 1014, which are control units regarding formation of a printed product. Further, the CPU circuit unit 1001 controls an HDD (Hard Disk Drive) I/F 1015 for controlling an HDD 1016, and a network I/F 1017, which are internal/external interface control units. A RAM (Random Access Memory) 1004 is a storage unit used as an area for temporarily holding control data, and a work area for calculation accompanying control.

The operation panel control unit 1005 controls the operation panel 425. The document feeder control unit 1006 controls the ADF 423. The image reader control unit 1007 controls the scanner 424. The image signal control unit 1008 performs control of performing image processing on received image data, converting the image data into an image signal interpretable by the printer control unit, and delivering the image signal to the printer control unit 1009. The printer control unit 1009 controls the developing units 405, 406, 407, and 408, the first fixing unit 413, the second fixing unit 414, and the like. The feeder control unit 1010 controls the external feeding apparatus 201, the external feeding apparatus 202, the feeding tray of the image forming apparatus main body 203, and the inserter apparatus 204.

The creaser control unit 1011 controls the creaser apparatus 205. The sheet folding apparatus control unit 1012 controls the sheet folding apparatus 206. The case binding control unit 1013 controls the case binding apparatus 207. The finisher control unit 1014 controls the finisher apparatus 208. The HDD I/F 1015 is an interface with the HDD 1016, and controls write/readout to/from the HDD 1016. The network I/F 1017 controls sending/reception of data via the network 104. The HDD 1016 is a large-capacity storage device and is a nonvolatile area where data are saved. The network I/F 1017 is connected to the image processing apparatus 102 and the information processing apparatus 103 via the network 104.

Control on each control unit by the CPU circuit unit 1001 at the time of a copy operation will be explained. Upon receiving a copy instruction from the operation panel control unit 1005, the CPU circuit unit 1001 uses the document feeder control unit 1006, and instructs the ADF 423 to feed documents of a document bundle one by one. The CPU circuit unit 1001 controls the scanner 424 via the image reader control unit 1007 to read the document and generate image data.

Then, the CPU circuit unit 1001 temporarily saves the generated image data in the RAM 1004, and transfers it to the image signal control unit 1008. The CPU circuit unit 1001 instructs the image signal control unit 1008 to convert the image data into an image signal interpretable by the printer control unit 1009, and deliver the image signal to the printer control unit 1009. At the same time, the CPU circuit unit 1001 uses the feeder control unit 1010 to issue an instruction to feed a printing medium from the external feeding apparatus 201 or 202 or the like. The printer control unit 1009 controls the developing units 405, 406, 407, and 408, the first fixing unit 413, the second fixing unit 414, and the like, and forms the read image on the fed medium.

The medium on which the image has been formed undergoes post-processes in accordance with an output form designated by the user. These post-processes are processes performed by the creaser control unit 1011, the sheet folding apparatus control unit 1012, the case binding control unit 1013, and the finisher control unit 1014.

For example, when performing crease processing on a medium, the CPU circuit unit 1001 uses the creaser control unit 1011 to execute crease processing on the medium. When folding a medium, the CPU circuit unit 1001 uses the sheet folding apparatus control unit 1012 to execute folding control. At this time, it is controlled to discharge the medium to the discharge portion 717 for a double parallel fold or C-fold, or convey the medium to the case binding apparatus 207 for a Z-fold, 6-page accordion fold, or single fold. When forming a case-bound product, the CPU circuit unit 1001 uses the case binding control unit 1013 to perform case-bound product formation processing and discharge media to the basket portion 819. When performing formation processing by the finisher apparatus 208, the CPU circuit unit 1001 uses the finisher control unit 1014 to perform processing corresponding to a designated discharge destination or a designated finishing setting such as saddle stitching or two-hole punching. The CPU circuit unit 1001 controls to discharge processed media to the sample tray 911, the stacking tray 914, or the saddle stacking portion 922.

Next, control on each control unit by the CPU circuit unit 1001 at the time of a print operation will be explained. The CPU circuit unit 1001 receives print image data from the image processing apparatus 102 via the network I/F 1017. The CPU circuit unit 1001 temporarily saves the received image data in the RAM 1004 and transfers it to the image signal control unit 1008. Subsequent control is the same as that of the copy operation, and a description thereof will not be repeated.

Figure 7B:
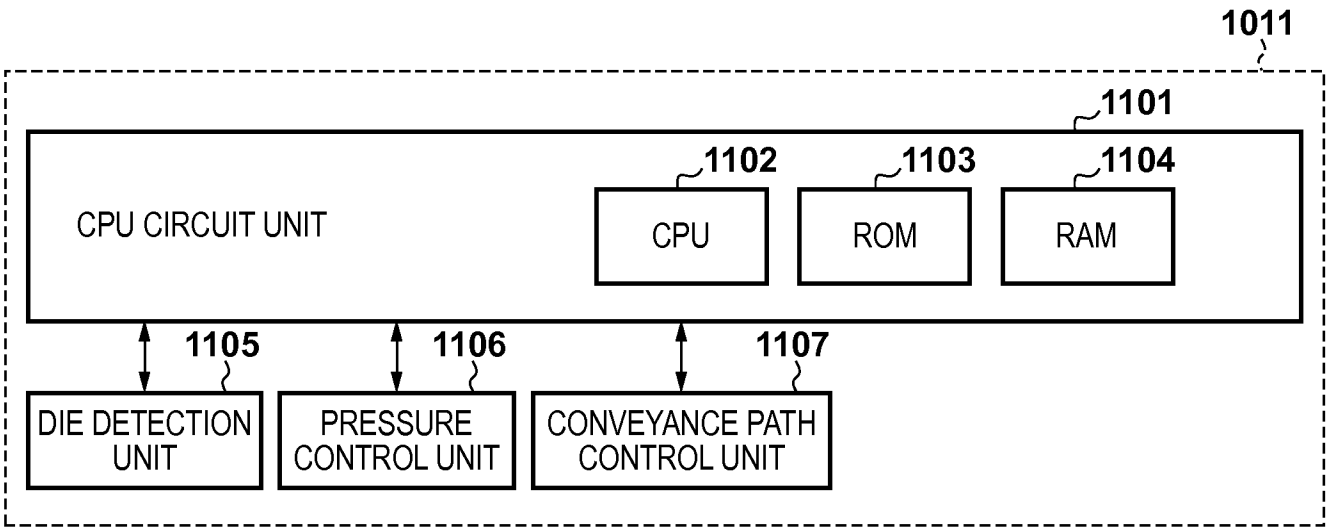

FIG. 7B is a block diagram showing in detail the creaser control unit 1011. A CPU circuit unit 1101 includes a CPU 1102, and controls the following control units in accordance with programs stored in a ROM 1103. These control units are a die detection unit 1105, a pressure control unit 1106, and a conveyance path control unit 1107. A RAM 1104 is used as an area for temporarily holding control data, and a work area for calculation accompanying control.

The CPU circuit unit 1101 is an intermediation circuit between the CPU circuit unit 1001, and the die detection unit 1105, pressure control unit 1106, and conveyance path control unit 1107. The CPU circuit unit 1101 has a function of intermediating an instruction from the CPU circuit unit 1001 and a notification from the control unit. The die detection unit 1105 is a detection unit that detects whether the creasing die 604 has been attached in the creaser apparatus 205.

The pressure control unit 1106 controls the pressure devices 606 to 608, and performs creasing by applying a pressure to the creasing die 604. The conveyance path control unit 1107 controls the flapper 603, the conveyance speed control unit 610, and the like, and performs switching of the conveyance path for a medium and control of the conveyance speed. That is, the CPU circuit unit 1001 can perform centralized control of the die detection unit 1105, pressure control unit 1106, and conveyance path control unit 1107 via the CPU circuit unit 1101, and can control crease processing and the conveyance path for the creaser apparatus 205.

Figure 7C:
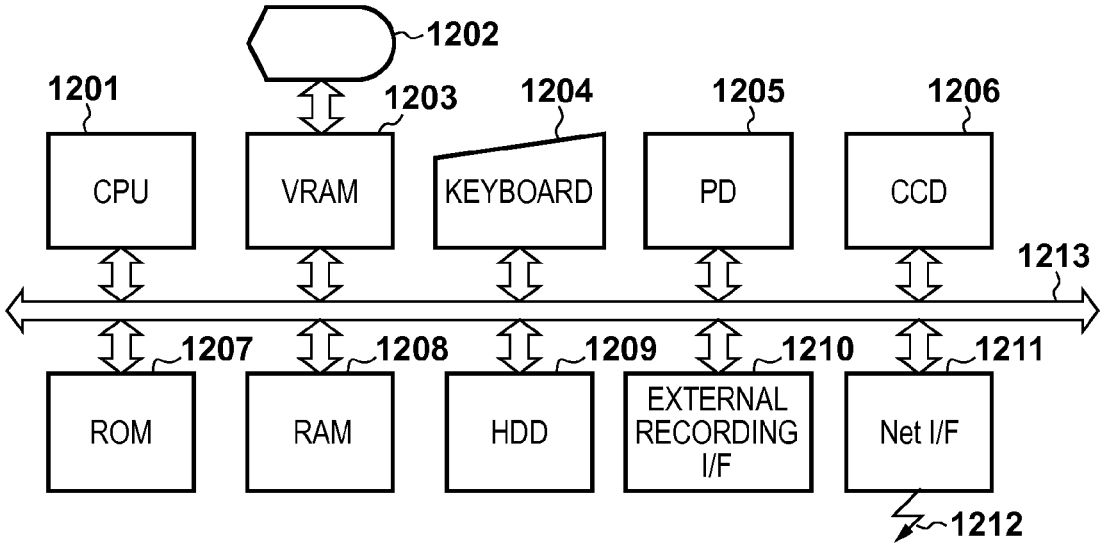

FIG. 7C is a block diagram showing the hardware arrangements of the image processing apparatus 102 and information processing apparatus 103. A CPU 1201 controls respective devices connected to a CPU device based on control programs stored in a ROM 1207, an HDD 1209, and a CDD (Compact Disk Drive) 1206.

The display window of a display device 1202 displays, for example, windows, icons, messages, menus, and other kinds of operator interface information. In a VRAM (Video Random Access Memory) 1203, a display image to be displayed on the display device 1202 is drawn. Display image data generated in the VRAM 1203 is transferred to the display device 1202 in accordance with a predetermined convention, and the display device 1202 displays the image. A keyboard 1204 includes various keys for inputting characters. A PD (Pointing Device) 1205 is used to designate, for example, icons, menus, and other objects displayed on the display screen of the display device 1202.

The CDD 1206 is a device that reads out/writes various control programs and data from/to a recording medium such as a CD-ROM or a CD-R. The CDD 1206 may also be a DVD drive. The ROM 1207 holds various control programs and data. A RAM 1208 has a work area for the CPU 1201, a data save area at the time of error processing, a control program loading area, and the like.

For example, the image processing apparatus 102 has a function of RIPing electronic data and sending the data to the image forming apparatus 101. A program corresponding to this program is stored in the ROM 1207. When performing RIP processing, the work area of the CPU 1201 or the RAM 1208 is used. The information processing apparatus 103 has a function of sending electronic data as a print job to the image processing apparatus 102. A program corresponding to this function is stored in the ROM 1207. When performing send processing, the work area of the CPU 1201 or the RAM 1208 is used.

The HDD 1209 is an internal recording device, and saves various control programs and various data. An external recording I/F 1210 is a device that performs readout/write from/to an external recording medium such as a USB memory. A network interface (Net-I/F) 1211 sends/receives data via a network 1212. In this embodiment, data can be sent/received between the image forming apparatus 101, the image processing apparatus 102, and the information processing apparatus 103 via the network 104. A CPU bus 1213 includes an address bus, a data bus, and a control bus.

[Software Arrangement]

Figure 8:
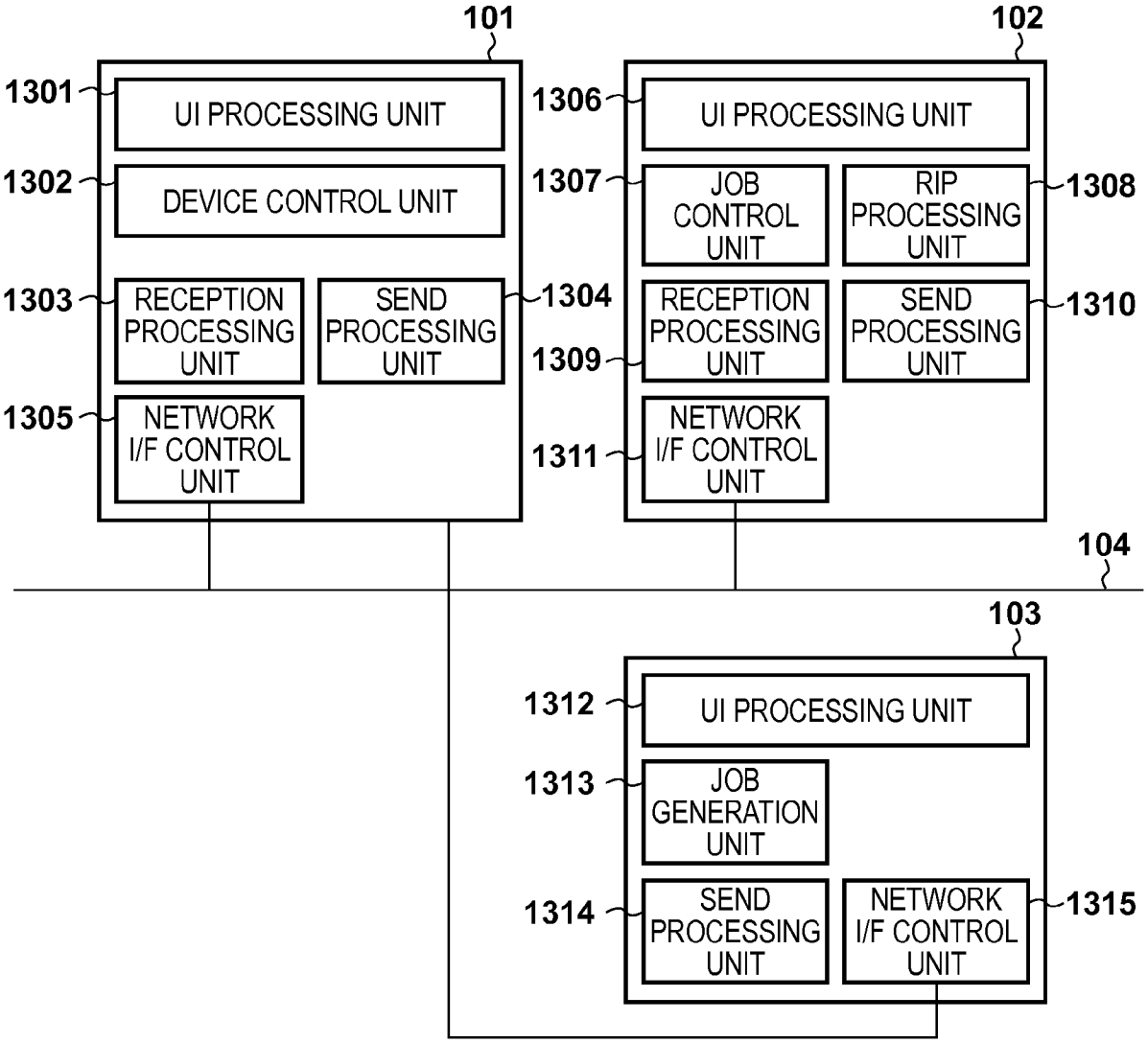
FIG. 8 is a block diagram showing an example of the software arrangements of the image forming apparatus and information processing apparatus.

FIG. 8 is a block diagram showing the software arrangements of the image forming apparatus 101, image processing apparatus 102, and information processing apparatus 103.

A UI processing unit 1301, a device control unit 1302, a reception processing unit 1303, a send processing unit 1304, and a network I/F control unit 1305 are software modules that are executed by the CPU circuit unit 1001 of the image forming apparatus 101. A UI processing unit 1306, a job control unit 1307, a RIP processing unit 1308, a reception processing unit 1309, a send processing unit 1310, and a network I/F control unit 1311 are software modules that are executed by the CPU 1201 of the image processing apparatus 102. A UI processing unit 1312, a job generation unit 1313, a send processing unit 1314, and a network I/F control unit 1315 are software modules that are executed by the CPU 1201 of the information processing apparatus 103.

The UI processing unit 1301 controls the operation panel control unit 1005, and takes charge of display of a setting window and the like regarding the image forming apparatus 101 on the operation panel 425. The UI processing unit 1301 takes charge of processing of saving/reading out values set on a setting window in/from the HDD 1016 of the image forming apparatus 101. The device control unit 1302 controls the CPU circuit unit 1001, and takes charge of processes such as image formation, creasing, folding, case-bound product formation, and saddle-stitched product formation by the image forming apparatus 101. The device control unit 1302 also takes charge of processing of reading out settings about printing from the HDD 1016 of the image forming apparatus 101 and reflecting them in print processing.

The reception processing unit 1303 takes charge of processing of receiving, via the network I/F control unit 1305, image data RIPed by the image processing apparatus 102, and delivering the image data for each page to the device control unit 1302. The send processing unit 1304 sends an event generated in the image forming apparatus 101, a state change notification, and the like via the network I/F control unit 1305. The network I/F control unit 1305 controls the network I/F 1017. Further, the network I/F control unit 1305 takes charge of data communication processing between the image forming apparatus 101 and the image processing apparatus 102 via the network 104 in cooperation with the network I/F control unit 1311.

The UI processing unit 1306 takes charge of processing of displaying a job state, settings, and the like on the display device 1202 of the image processing apparatus 102 when the image forming apparatus 101 and the image processing apparatus 102 execute a print job. The job control unit 1307 takes charge of print job send processing to the image forming apparatus 101. More specifically, the job control unit 1307 performs processing such as sending of a print start request and job setting information for a print job. The RIP processing unit 1308 takes charge of processing of RIPing print data for each page.

The reception processing unit 1309 takes charge of processing of receiving an event, state change, and the like from the image forming apparatus 101 via the network I/F control unit 1311, and delivering them to the UI processing unit 1306. Further, the reception processing unit 1309 takes charge of processing of transferring, to the job control unit 1307, a print job that has been received from the information processing apparatus 103 via the network I/F control unit 1311. The send processing unit 1310 takes charge of processing of transferring RIPed image data for each page to the reception processing unit 1303 of the image forming apparatus 101 via the network I/F control unit 1311. The network I/F control unit 1311 controls the Net-I/F 1211. The network I/F control unit 1311 performs data communication processing between the image forming apparatus 101, the image processing apparatus 102, and the information processing apparatus 103 via the network 104.

The UI processing unit 1312 takes charge of processing of displaying a job setting window on the display device 1202 of the information processing apparatus 103, and processing of delivering, to the job generation unit 1313, an instruction to generate a print job. The job generation unit 1313 takes charge of processing of generating a print job in accordance with an instruction from the UI processing unit 1312, and delivering print data to the send processing unit 1314. The send processing unit 1314 takes charge of delivering a print job to the reception processing unit 1309 of the image processing apparatus 102 via the network I/F control unit 1315. The network I/F control unit 1315 controls the Net-I/F 1211. Further, the network I/F control unit 1315 takes charge of data communication processing between the image processing apparatus 102 and the information processing apparatus 103 via the network 104 in cooperation with the network I/F control unit 1311.

In this arrangement, a case in which the image processing apparatus 102 sends a print job from the information processing apparatus 103 and RIPs it, and then the image forming apparatus 101 prints is implemented by performing the following processing. First, the job generation unit 1313 of the information processing apparatus 103 generates a job in accordance with job settings made by the UI processing unit 1312. The information processing apparatus 103 sends the generated print data and job setting information of the print job to the job control unit 1307 of the image processing apparatus 102 by using the send processing unit 1314. The job control unit 1307 of the image processing apparatus 102 renders the received print data for each page by using the RIP processing unit 1308, and sends the RIPed image data to the device control unit 1302 of the image forming apparatus 101 by using the send processing unit 1310. The job control unit 1307 of the image processing apparatus 102 sends the job setting information to the device control unit 1302 of the image forming apparatus 101 by using the send processing unit 1310 in synchronism with the sending of the RIPed image data.

The device control unit 1302 of the image forming apparatus 101 receives the received RIPed image data, delivers the image data to the image signal control unit 1008, and receives the job setting information. Based on the job setting information, the device control unit 1302 issues instructions about the feeding tray and discharge destination to the printer control unit 1009, the feeder control unit 1010, the finisher control unit 1014, and the like. At this time, when controlling creasing or folding, the device control unit 1302 also issues instructions to the creaser control unit 1011 and the sheet folding apparatus control unit 1012. In addition to issuing the instructions, the device control unit 1302 instructs the image signal control unit 1008 to deliver the image data to the printer control unit 1009.

[Arrangement of Job Setting Window]

Figure 9A:
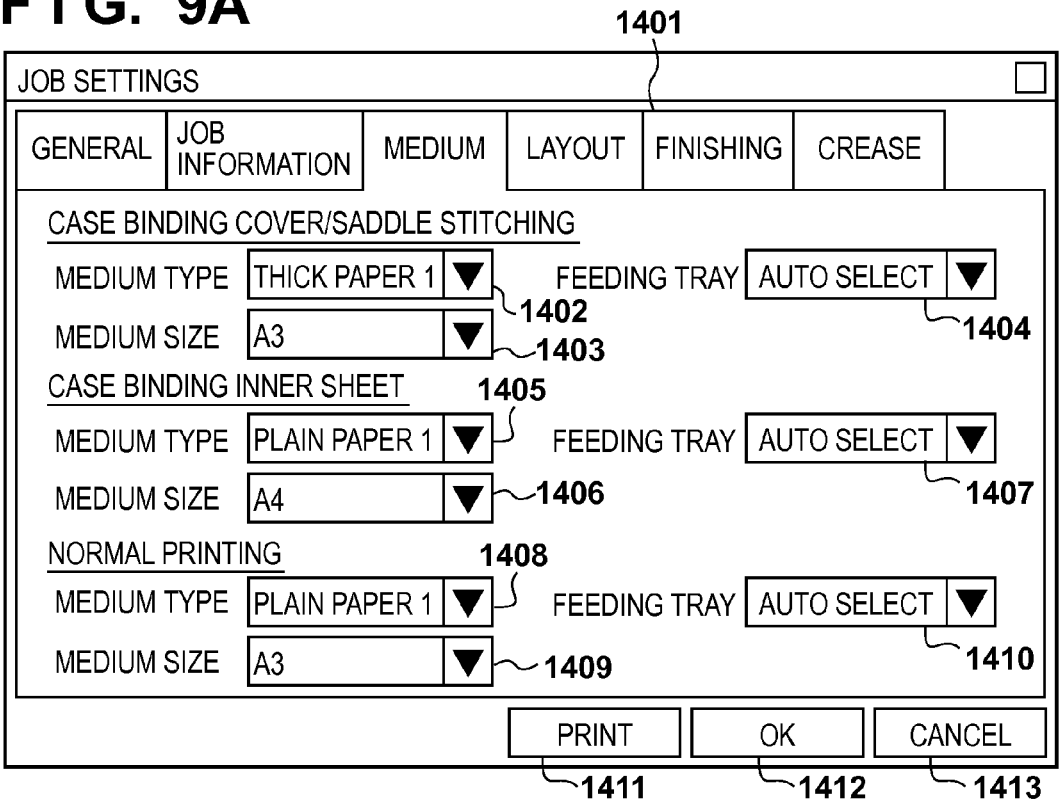
FIGS. 9A, 9B, 9C, and 9D are views each showing an example of a job setting window.

FIGS. 9A to 9D show job setting windows displayed on the display device 1202 of the information processing apparatus 103. This implements an acceptance unit that accepts job settings including a crease setting. In FIG. 9A, a tag 1401 is a tag obtained by grouping job setting items by the type, and is constituted by six types "general", "job information", "medium", "layout", "finishing", and "crease". In FIG. 9A, the setting item "medium" is displayed. The "medium" tag is a tag that collects settings associated with a medium used by a print job.

A medium type setting 1402, a medium size setting 1403, and a feeding tray setting 1404 are setting items about a medium used for a case binding cover or saddle stitching. In FIG. 9A, "thick paper 1" is selected in the medium type setting 1402, "A3" is selected in the medium size setting 1403, and "auto select" is selected in the feeding tray setting 1404. That is, it is set in FIG. 9A to print by feeding a medium from an arbitrary feeding tray as long as the medium type "thick paper 1" and the medium size "A3" are set for this feeding tray.

A medium type setting 1405, a medium size setting 1406, and a feeding tray setting 1407 are setting items about a medium used as a case binding inner sheet. In FIG. 9A, "plain paper 1" is selected in the medium type setting 1405, "A4" is selected in the medium size setting 1406, and "auto select" is selected in the feeding tray setting 1407. That is, it is set in FIG. 9A to print by feeding a medium from an arbitrary feeding tray as long as the medium type "plain paper 1" and the medium size "A4" are set for this feeding tray.

A medium type setting 1408, a medium size setting 1409, and a feeding tray setting 1410 are setting items about a medium used when neither case binding nor saddle stitching is performed. In FIG. 9A, "plain paper 1" is selected in the medium type setting 1408, "A3" is selected in the medium size setting 1409, and "auto select" is selected in the feeding tray setting 1410. That is, it is set in FIG. 9A to print by feeding a medium from an arbitrary feeding tray as long as the medium type "plain paper 1" and the medium size "A3" are set for this feeding tray.

A print button 1411 is a button for starting printing with contents set on the job setting window. An OK button 1412 is a button for deciding contents set on the job setting window as job settings. A cancel button 1413 is a button for discarding contents set on the job setting window.

Figure 9B:
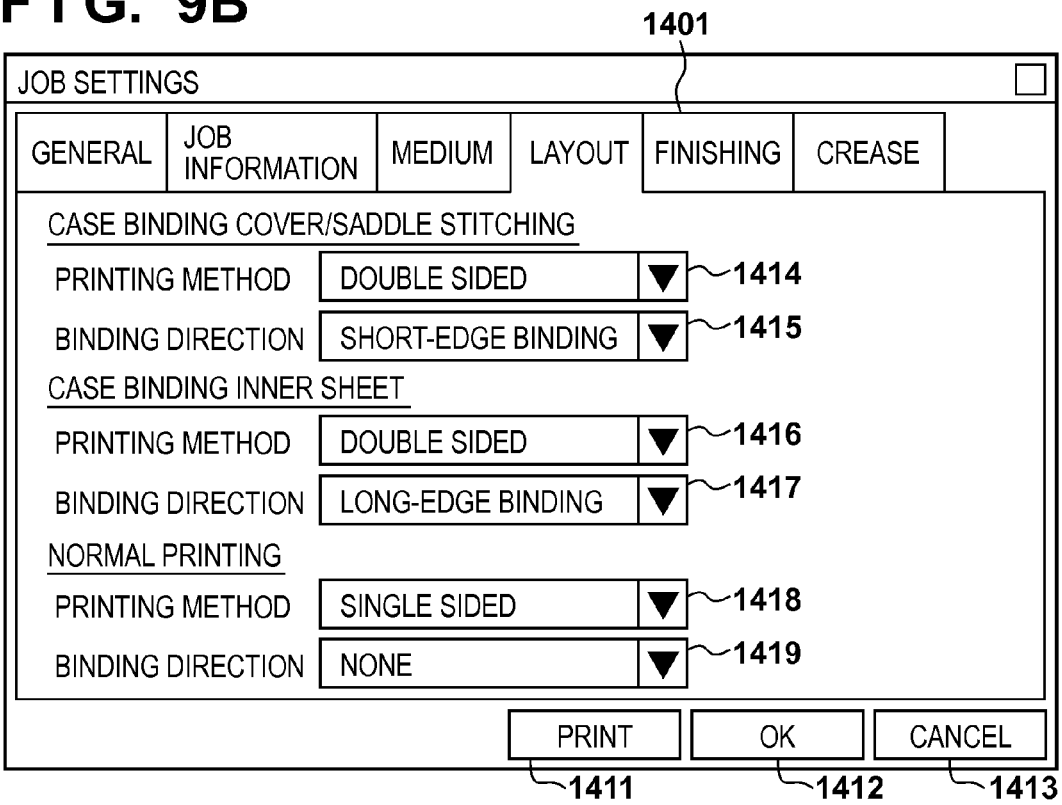

In FIG. 9B, the setting item "layout" is displayed. The "layout" tag is a tag that collects settings about a printing layout. A printing method setting 1414 and a binding direction setting 1415 are setting items about the layout of a case binding cover or saddle stitching. In FIG. 9B, "double sided" is selected in the printing method setting 1414, and "short-edge binding" is selected in the binding direction setting 1415. That is, it is set in FIG. 9B as the layout of the case binding cover or saddle stitching to perform double-sided printing for image data of two pages by short-edge binding.

A printing method setting 1416 and a binding direction setting 1417 are setting items about the layout of a case binding inner sheet. In FIG. 9B, "double sided" is selected in the printing method setting 1416, and "long-edge binding" is selected in the binding direction setting 1417. That is, it is set in FIG. 9B as the layout of a case binding inner sheet to perform double-sided printing for image data of two pages by long-edge binding. A printing method setting 1418 and a binding direction setting 1419 are setting items about a layout when neither case binding nor saddle stitching is performed. In FIG. 9B, "single sided" is selected in the printing method setting 1418, and "none" is selected in the binding direction setting 1419. That is, it is set in FIG. 9B as a layout when neither case binding nor saddle stitching is performed, to perform single-sided printing for image data of one page. The print button 1411, the OK button 1412, and the cancel button 1413 are the same as those in FIG. 9A, and a description thereof will not be repeated.

Figure 9C:
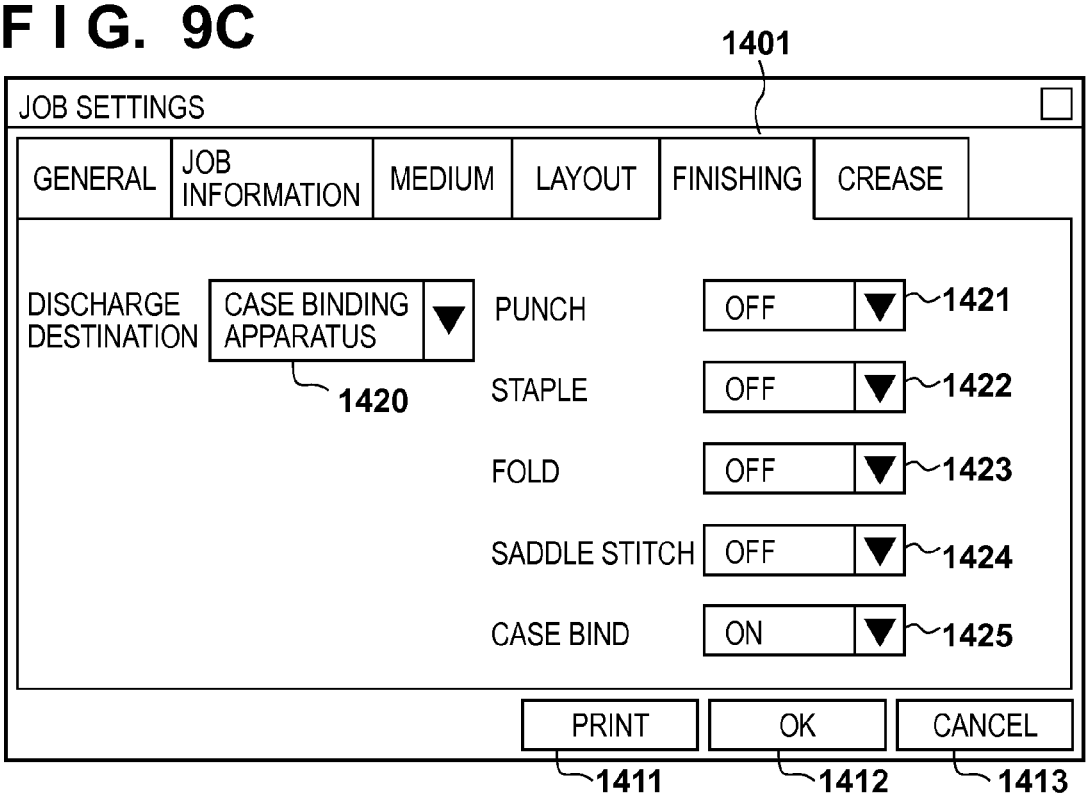

In FIG. 9C, the setting item "finishing" is displayed. The "finishing" tag is a tag that collects settings about discharge and formation. A discharge destination setting 1420 is a setting about designation of a discharge destination, and "case binding apparatus" is selected in FIG. 9C. In this setting, the sample tray 911, stacking tray 914, and saddle stacking portion 922 of the finisher apparatus 208, and the like are selectable in addition to the case binding apparatus.

A punch setting 1421 is an item for setting whether to perform punch processing on a medium when discharging the medium to the finisher apparatus 208. In FIG. 9C, "OFF" is designated in the punch setting 1421. A staple setting 1422 is an item for setting whether to perform staple processing on a medium when discharging the medium to the finisher apparatus 208. In FIG. 9C, "OFF" is designated in the staple setting 1422. A fold setting 1423 is an item for setting whether to perform fold processing by the sheet folding apparatus 206. In FIG. 9C, "OFF" is designated in the fold setting 1423. In this setting, "Z-fold", "6-page accordion fold", "single fold", "double parallel fold", and "C-fold" as described with reference to FIG. 5B are selectable in addition to "OFF".

A saddle stitching setting 1424 is an item for setting whether to perform saddle stitch processing on a medium when discharging the medium to the finisher apparatus 208. In FIG. 9C, "OFF" is set in the saddle stitching setting 1424. A case binding setting 1425 is an item set when forming a case-bound product by the case binding apparatus 207. In FIG. 9C, ON is set in the case binding setting 1425. The print button 1411, the OK button 1412, and the cancel button 1413 are the same as those in FIG. 9A, and a description thereof will not be repeated.

Figure 9D:
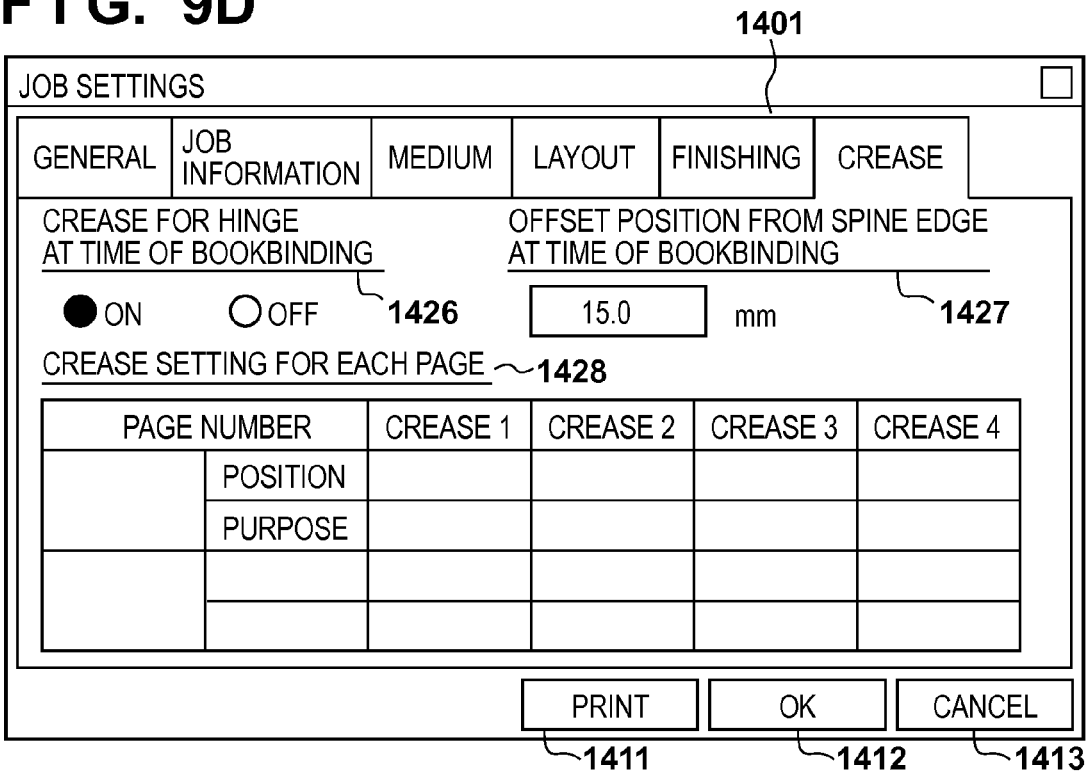

In FIG. 9D, the setting item "crease" is displayed. The "crease" tag is a tag that collects settings about crease processing. A crease setting 1426 for a hinge at the time of bookbinding is a setting about whether to make a crease at a hinge position at the time of case binding and saddle stitching. In FIG. 9D, "ON" is selected. This setting is a radio button setting, and "ON" or "OFF" is alternatively selected.

An offset position 1427 from a spine edge at the time of bookbinding is a setting about a position where a crease for a hinge is made when the crease setting 1426 for a hinge at the time of bookbinding is "ON". In FIG. 9D, it is set to make a crease for a hinge at a position of "15.0 mm" from a spine edge. A crease setting 1428 for each page is an item representing the position and purpose of a crease for each page. In FIG. 9D, nothing is set in the crease setting for each page (no setting). The print button 1411, the OK button 1412, and the cancel button 1413 are the same as those in FIG. 9A, and a description thereof will not be repeated.

Note that the settings on the respective windows shown in FIGS. 9A to 9D are read out from or written in the HDD 1209 by the UI processing unit 1312 using the CPU 1201. When executing printing, the UI processing unit 1312 performs processing of requesting the job generation unit 1313 to generate a job.

[Description of Hinge]

Figure 10A:
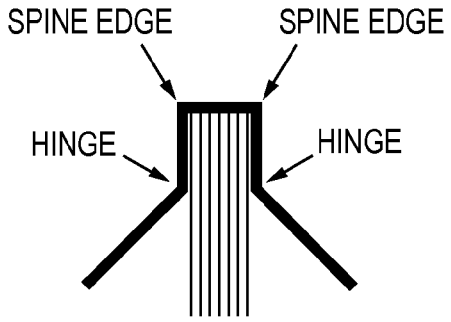
FIGS. 10A, 10B, and 10C are views respectively showing a hinge position in case binding, and the relationship between crease positions on a cover.
Figure 10B:
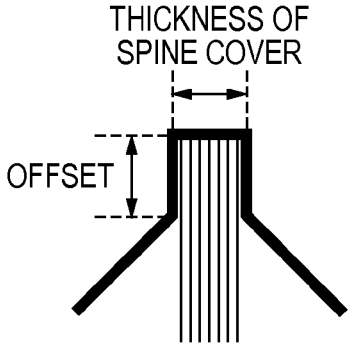
Figure 10C:
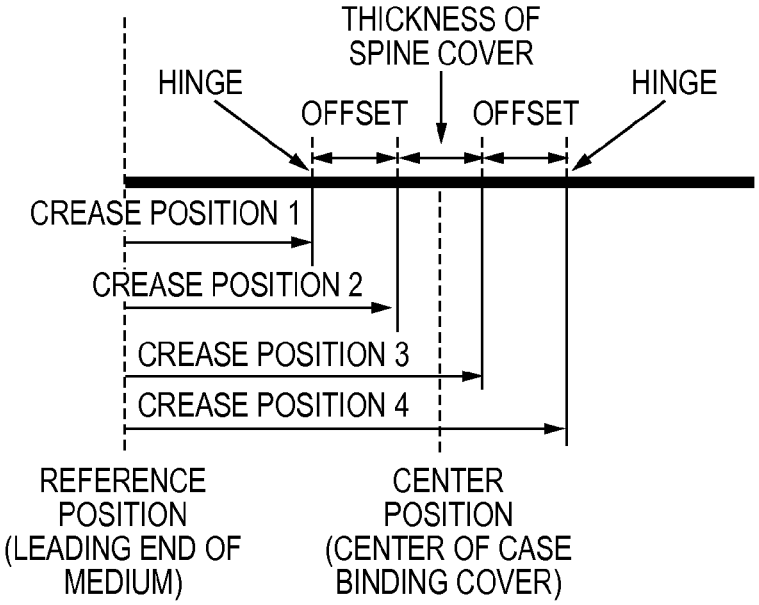

FIGS. 10A to 10C give a description of a hinge for a case binding cover. The "spine edge", "hinge", and "offset" in this embodiment will be clearly defined with reference to FIGS. 10A to 10C. Further, the relationship between "spine edge", "hinge", "offset", "crease position 1", "crease position 2", "crease position 3", and "crease position 4" will be explained.

FIGS. 10A and 10B show the positional relationship between the spine edge and the hinge in regard to case binding. As shown in FIG. 10A, one hinge exists for each of front and back covers in case binding. The interval between the spine edge and the hinge is defined by a name "offset", and the interval between two spine edges is defined by a name "thickness of the spine cover". Note that the offset in FIG. 10B corresponds to the "offset position from a spine edge at the time of bookbinding" 1427 shown in FIG. 9D. In the example of FIG. 9D, the length of the offset in FIG. 10B is set to be "15.0 mm".

FIG. 10C shows the positions of the spine edge and hinge from a reference position (leading end of a medium) for a case binding cover. As described above with reference to FIG. 6A, an inner sheet bundle is glued to the center of a case binding cover. Therefore, lengths from the reference position (leading end of a medium) to "crease position 1", "crease position 2", "crease position 3", and "crease position 4" have a relationship shown in FIG. 10C with the length of a medium serving as a case binding cover, the thickness of the spine cover, and the offset. Note that the thickness of the spine cover depends on the type and number of media used as case binding inner sheets, and changes for each case-bound product to be generated.

The relationship in FIG. 10C is represented by the following equations:

crease position 1 (hinge)=(length of case binding cover/2)−(thickness of spine cover/2)−offset value crease position 2 (spine edge)=(length of case binding cover/2)−(thickness of spine cover/2)

crease position 3 (spine edge)=(length of case binding cover/2)+(thickness of spine cover/2)

crease position 4 (hinge)=(length of case binding cover/2)+(thickness of spine cover/2)+offset value FIG. 11 shows an example of the arrangement of a management table for a pressure when making a crease (to be referred to as a "creasing pressure" hereinafter). A management table 1600 is saved in the HDD 1016 of the image forming apparatus 101. In FIG. 11, a medium ID 1601 is an identifier (identification information) for uniquely identifying a medium. A medium type 1602 is the name of a medium for each medium ID. The value of the medium type 1602 is displayed in the medium type settings 1402, 1405, and 1408 in FIG. 9A. A creasing pressure 1603 for a hinge is a pressure when the creasing purpose is "hinge". A creasing pressure 1604 for a spine edge is a pressure when the creasing purpose is "spine edge".

In the example of FIG. 11, creasing pressures appropriate for respective creasing purposes are managed in association with three respective types of media. Note that a creasing pressure managed in the management table 1600 is a creasing pressure used when the creaser apparatus 205 performs crease processing on a medium. Medium types are not limited to those shown in FIG. 11, and another type of medium may be registered and handled. A creasing pressure may be further defined for another creasing purpose. The creasing pressures associated with respective media shown in FIG. 11 are merely an example and, for example, another creasing pressure obtained empirically or experimentally may be used.

First Embodiment

The first embodiment will explain a case in which when an information processing apparatus 103 sends a case binding job to an image processing apparatus 102, a "crease for a hinge" and a "crease for a spine edge (crease for a fold)" are made on a case binding cover.

The premise of the first embodiment will be explained. First, assume that the above-described settings shown in FIGS. 9A to 9D are made as settings of the case binding job sent from the information processing apparatus 103.

When the operator presses a print button 1411 in the information processing apparatus 103, a UI processing unit 1312 of the information processing apparatus 103 requests a job generation unit 1313 to generate a job, and the job generation unit 1313 generates a case binding job. Assume that the job generation unit 1313 has sent the generated job to a job control unit 1307 of the image processing apparatus 102 by using a send processing unit 1314.

[Processing Sequence]

Figure 12:
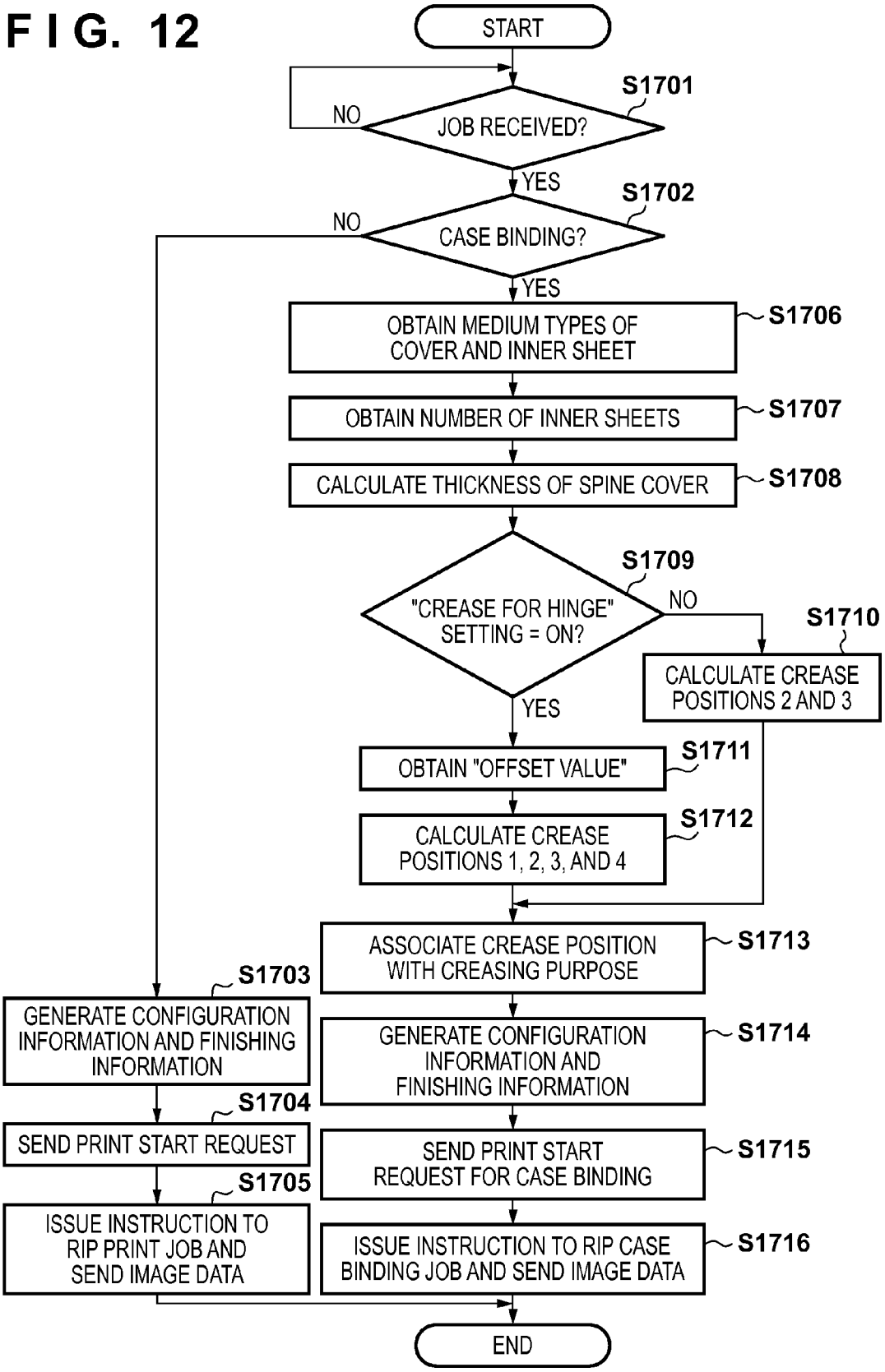
FIG. 12 is a flowchart showing processing by an image processing apparatus according to the first embodiment.
Figure 13:
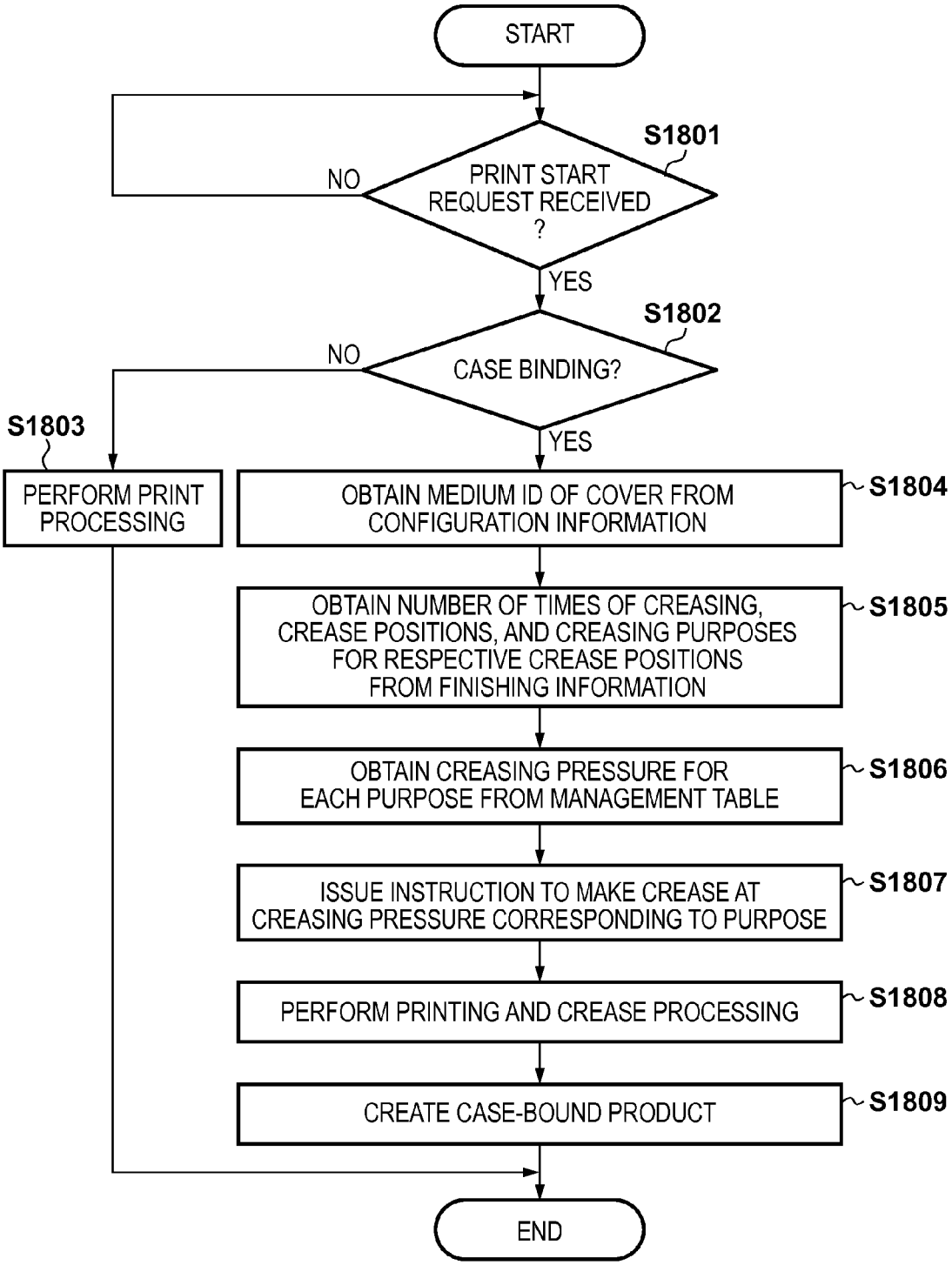
FIG. 13 is a flowchart showing processing by an image forming apparatus according to the first embodiment.

The first embodiment will be explained with reference to the flowcharts of FIGS. 12 and 13. FIG. 12 is a flowchart showing processing to be executed by the job control unit 1307 of the image processing apparatus 102. A program regarding this processing is stored in a ROM 1207 of the image processing apparatus 102, and read out and executed by a CPU 1201. FIG. 13 is a flowchart showing processing to be executed by a device control unit 1302 of an image forming apparatus 101. A program regarding this processing is stored in a ROM 1003 of the image forming apparatus 101, and read out and executed by a CPU 1002.

(Processing in Image Processing Apparatus)

First, processing in FIG. 12 will be explained. When the process starts, the job control unit 1307 determines in step S1701 whether it has received a print job from the job generation unit 1313. If the job control unit 1307 has received a print job (YES in step S1701), it advances to step S1702. If the job control unit 1307 has not received a print job (NO in step S1701), it waits until it receives a print job.

In step S1702, the job control unit 1307 analyzes job setting information of the received print job, and determines whether the print job is a case binding job. More specifically, when a discharge destination setting 1420 is "case binding apparatus" and a case binding setting 1425 is "ON", it is determined that the print job is a case binding job. If the received print job is a case binding job (YES in step S1702), the job control unit 1307 advances to step S1706. If the received print job is not a case binding job (NO in step S1702), the job control unit 1307 advances to step S1703.

In step S1703, the job control unit 1307 generates configuration information based on items set in "medium" and "layout" of the job setting window. At this time, the job control unit 1307 inquires, of the device control unit 1302 of the image forming apparatus 101, the medium ID of a medium type set in a medium type setting 1402 or 1408, and sets the obtained medium ID in the configuration information. Also, the job control unit 1307 generates finishing information based on items set in "finishing" and "crease" of the job setting window.

In step S1704, the job control unit 1307 sends a print start request to the device control unit 1302 of the image forming apparatus 101. Together with this request, the job control unit 1307 sends the configuration information and finishing information generated in step S1703. In step S1705, the job control unit 1307 instructs an RIP processing unit 1308 to send RIPed image data of the print job to the device control unit 1302 of the image forming apparatus 101. Then, the job control unit 1307 ends this processing sequence.

In step S1706, the job control unit 1307 analyzes the job setting information of the received print job, and obtains the medium types of a case binding cover and case binding inner sheet. In the example of FIG. 9A, these medium types correspond to the medium type setting 1402 and a medium type setting 1405.

In step S1707, the job control unit 1307 analyzes the job setting information of the received print job, and calculates the number of inner sheets. More specifically, the number of inner sheets is calculated based on the number of logical pages included in the print job, and the setting of a printing method setting 1416. In the example of FIG. 9B, the printing method setting 1416 is "double sided". Thus, the number of logical pages is divided by 2, and the result of adding a remainder to the quotient serves as the number of inner sheets. When the printing method setting 1416 is "single sided", the number of logical pages directly indicates the number of inner sheets.

In step S1708, the job control unit 1307 calculates the thickness of the spine cover according to:

thickness of spine cover=(thickness of medium serving as case binding cover)+(thickness of medium serving as case binding inner sheet×number of inner sheets)

The thickness of each medium to be used here is saved in advance in an HDD 1016 of the image forming apparatus 101, and is managed in association with the medium ID. The thickness of each medium is obtained by inquiring it of the device control unit 1302 of the image forming apparatus 101 by the job control unit 1307. Note that the spine cover thickness calculation equation is not limited to this embodiment and may be an equation considering a mixture of media serving as inner sheets. An external factor such as gluing may also be taken into account.

In step S1709, the job control unit 1307 analyzes the job setting information of the received print job, obtains a crease setting 1426 for a hinge at the time of bookbinding, and confirms the setting content. If the crease setting 1426 for a hinge at the time of bookbinding is ON (YES in step S1709), the job control unit 1307 advances to step S1711. If the crease setting 1426 for a hinge at the time of bookbinding is OFF (NO in step S1709), the job control unit 1307 advances to step S1710.

In step S1710, the job control unit 1307 calculates crease position 2 and crease position 3. The job control unit 1307 analyzes the job setting information of the received print job, and obtains a medium size from a medium size setting 1403. In the example of FIG. 9A, "A3" is designated in the medium size setting 1403. "A3" is a standard size, and its size in the conveyance direction is 420.0 mm. The job control unit 1307 calculates crease position 2 and crease position 3 based on the medium size setting 1403 and the thickness of the spine cover calculated in step S1708. After that, the job control unit 1307 advances to step S1713. Here, assume that information about the length (size) of a standard-size medium is held in the image processing apparatus 102, and the information about the length of a standard size is saved in advance in an HDD 1209.

In step S1711, the job control unit 1307 analyzes the job setting information of the received print job, and obtains an offset position 1427 from a spine edge at the time of bookbinding. In step S1712, the job control unit 1307 calculates crease position 1, crease position 2, crease position 3, and crease position 4. The job control unit 1307 analyzes the job setting information of the received print job, and obtains a medium size from the medium size setting 1403. In the example of FIG. 9A, "A3" is designated in the medium size setting 1403. "A3" is a standard size, and its size in the conveyance direction is 420.0 mm. The job control unit 1307 calculates the four crease positions based on the medium size setting 1403, the thickness of the spine cover calculated in step S1708, and the offset position 1427 from a spine edge at the time of bookbinding that has been obtained in step S1711.

In step S1713, the job control unit 1307 associates the crease position calculated in step S1710 or S1712 with a creasing purpose. More specifically, after passing through the processing in step S1710, the job control unit 1307 decides that two creases at crease position 2 and crease position 3 have the purpose "crease for a spine edge (crease for a fold)" on a case binding cover, and associates them. In this case, a "crease for a hinge" does not exist. After passing through the processing in step S1712, the job control unit 1307 decides that two creases at crease position 1 and crease position 4 have the purpose "crease for a hinge" on a case binding cover, and associates them. Further, the job control unit 1307 decides that two creases at crease position 2 and crease position 3 have the purpose "crease for a spine edge (crease for a fold)", and associates them.

In step S1714, the job control unit 1307 generates configuration information based on items set in "medium" and "layout" of the job setting window. At this time, the job control unit 1307 inquires, of the device control unit 1302 of the image forming apparatus 101, the medium ID of a medium type set in the medium type setting 1402 or 1408, and sets the obtained medium ID in the configuration information. Also, the job control unit 1307 generates finishing information based on items set in "finishing" and "crease" of the job setting window. At this time, the job control unit 1307 sets, in the finishing information, even the association information of the crease position and creasing purpose that has been generated in step S1713.

In step S1715, the job control unit 1307 sends a print start request to the device control unit 1302 of the image forming apparatus 101. Together with this request, the job control unit 1307 sends the configuration information and finishing information generated in step S1714. In step S1716, the job control unit 1307 instructs the RIP processing unit 1308 to send RIPed image data of the case binding job to the device control unit 1302 of the image forming apparatus 101. Then, the job control unit 1307 ends this processing sequence.

(Processing in Image Forming Apparatus)

Next, processing in FIG. 13 will be explained. When the process starts, the device control unit 1302 of the image forming apparatus 101 determines in step S1801 whether it has received a print start request for a print job from the job control unit 1307. If the device control unit 1302 has received a print start request (YES in step S1801), it advances to step S1802. If the device control unit 1302 has not received a print start request (NO in step S1801), it waits until it receives a print start request.

In step S1802, the device control unit 1302 analyzes finishing information of the received print job, and determines whether the print job is a case binding job. More specifically, when the discharge destination setting 1420 described with reference to FIG. 9C is "case binding apparatus" and the case binding setting 1425 is "ON", it is determined that the print job is a case binding job. If the print request is case binding (YES in step S1802), the device control unit 1302 advances to step S1804. If the print request is not case binding (NO in step S1802), the device control unit 1302 advances to step S1803.

In step S1803, the device control unit 1302 performs print processing by the image forming apparatus 101 based on the configuration information and finishing information of the received print job. Then, the device control unit 1302 ends this processing sequence.

In step S1804, the device control unit 1302 analyzes the configuration information of the received print request, and obtains the medium ID of a case binding cover. In step S1805, the device control unit 1302 analyzes the finishing information of the received print job, and obtains the number of times of creasing, crease positions, and creasing purposes for the respective crease positions. More specifically, when the image processing apparatus 102 has passed through the processing in step S1710 of FIG. 12, "2" is obtained as the number of times of creasing, crease position 2 and crease position 3 are obtained as crease positions, and the "crease for a spine edge (crease for a fold)" is obtained as a creasing purpose for each crease position. When the image processing apparatus 102 has passed through the processing in step S1712 of FIG. 12, "4" is obtained as the number of times of creasing, and crease position 1, crease position 2, crease position 3, and crease position 4 are obtained as crease positions. As the creasing purpose, the "crease for a hinge" is obtained for crease position 1 and crease position 4, and the "crease for a spine edge (crease for a fold)" is obtained for crease position 2 and crease position 3.

In step S1806, the device control unit 1302 obtains, from a creasing pressure management table 1600 saved in the HDD 1016, a "creasing pressure for a hinge" and a "creasing pressure for a spine edge" for all medium IDs obtained in step S1804. Since "thick paper 1" is designated in the medium type setting 1402 in this embodiment, "140 Kgf" is obtained as the creasing pressure for a hinge, and "100 Kgf" is obtained as the creasing pressure for a spine edge.

In step S1807, the device control unit 1302 instructs a CPU circuit unit 1101 of a creaser apparatus 205 via a CPU circuit unit 1001 of the image forming apparatus 101 about crease processing on a case binding cover. At this time, the device control unit 1302 issues an instruction to perform creasing based on the settings obtained in steps S1805 and S1806. More specifically, an instruction is issued to perform creasing at "140 Kgf" as the creasing pressure for a hinge at a position where it is set to make a crease for a hinge. When it is set to make a crease for a spine edge (crease for a fold), an instruction is issued to perform creasing at "100 Kgf" as the pressure of a crease for a spine edge (crease for a fold). As described above with reference to FIG. 4, the creasing pressure can be controlled to an arbitrary pressure by controlling pressure devices 606 to 608.

In step S1808, the device control unit 1302 controls the CPU circuit unit 1001 of the image forming apparatus 101 to execute printing on a medium used for case binding, and execute crease processing on a case binding cover. In step S1809, the device control unit 1302 instructs a case binding control unit 1013 via the CPU circuit unit 1001 of the image forming apparatus 101 to form a case-bound product. After that, the device control unit 1302 ends this processing sequence. By this processing, the case-bound product is formed using media printed and creased in step S1808.

As described above, a crease can be made on a case binding cover at a plurality of creasing pressures in accordance with creasing purposes.

Second Embodiment

The second embodiment will explain a case in which when an information processing apparatus 103 sends a print job to an image processing apparatus 102, a "crease for a hinge" and a "crease for a spine edge (crease for a fold)" are made on an arbitrary medium. This embodiment will give an explanation by exemplifying a case in which printing and creasing on a medium used in case binding are performed when executing offline case binding.

FIG. 14 shows a setting window according to the second embodiment that corresponds to the setting window shown in FIG. 9D in the first embodiment. A crease setting 1901 for a hinge at the time of bookbinding is a setting about whether to make a crease at a hinge position at the time of case binding and saddle stitching. In FIG. 14, "OFF" is selected. This setting is a radio button setting, and "ON" or "OFF" is alternatively selected.

A crease setting 1903 for each page is an item representing the position and purpose of a crease for each page. In FIG. 14, it is set to make four creases for the first page. It is also set to make "creases for hinges" at positions of 200 mm and 240 mm from the leading end of a sheet, and "creases for spine edges (creases for folds)" at positions of 210 mm and 230 mm. An offset position 1902 from a spine edge at the time of bookbinding, a print button 1904, an OK button 1905, and a cancel button 1906 are the same as those in FIG. 9A, and a description thereof will not be repeated.

The second embodiment assumes that a stacking tray 914 of a finisher apparatus 208 is set in a discharge destination setting 1420 shown in FIG. 9C. Further, the second embodiment assumes that data to be printed for the first page is print data of a case binding cover and the remaining data are print data of case binding inner sheets.

[Processing Sequence]

Figure 15A:
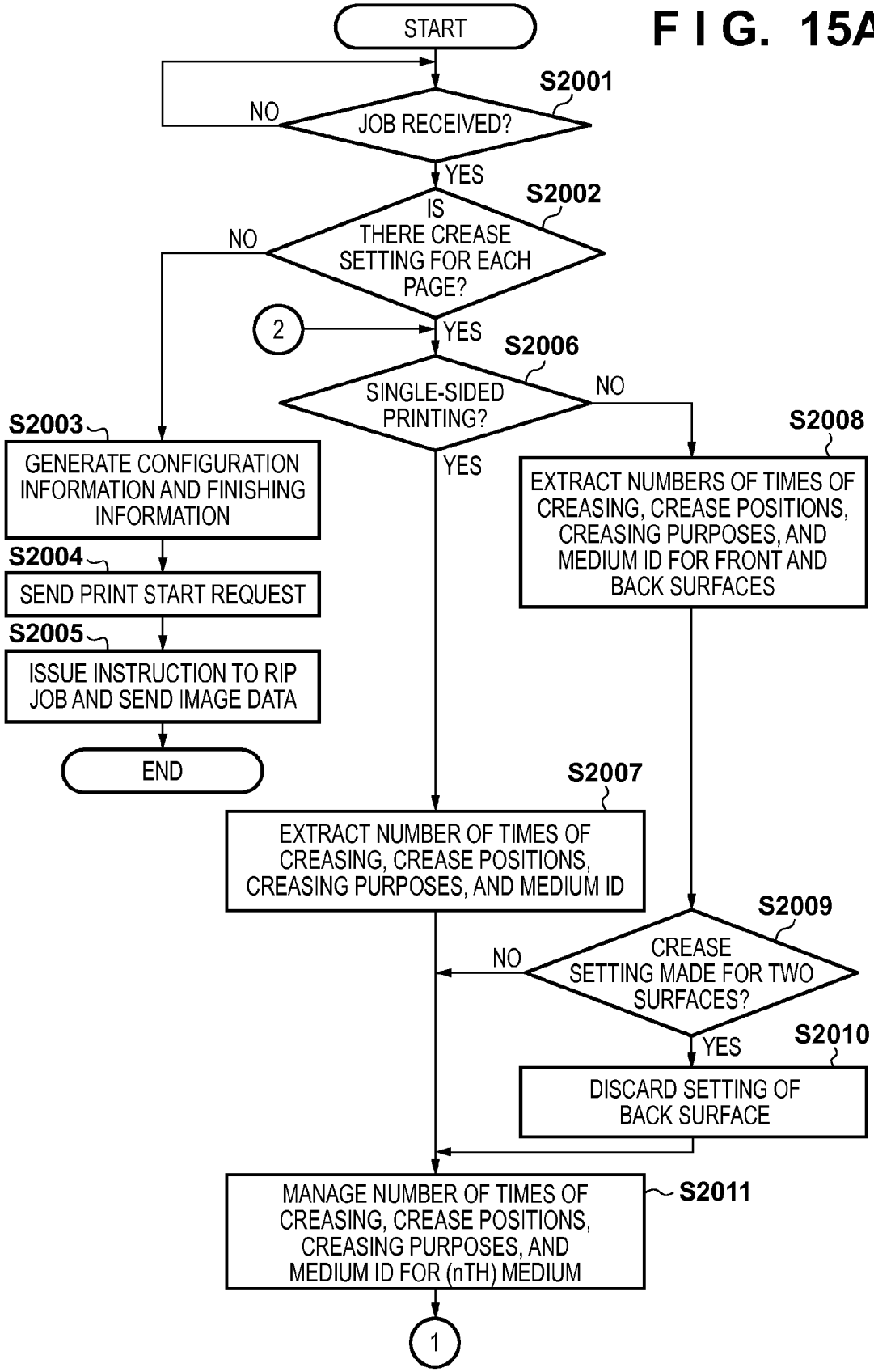
FIGS. 15A and 15B are flowcharts showing processing by an image processing apparatus according to the second embodiment.
Figure 15B:
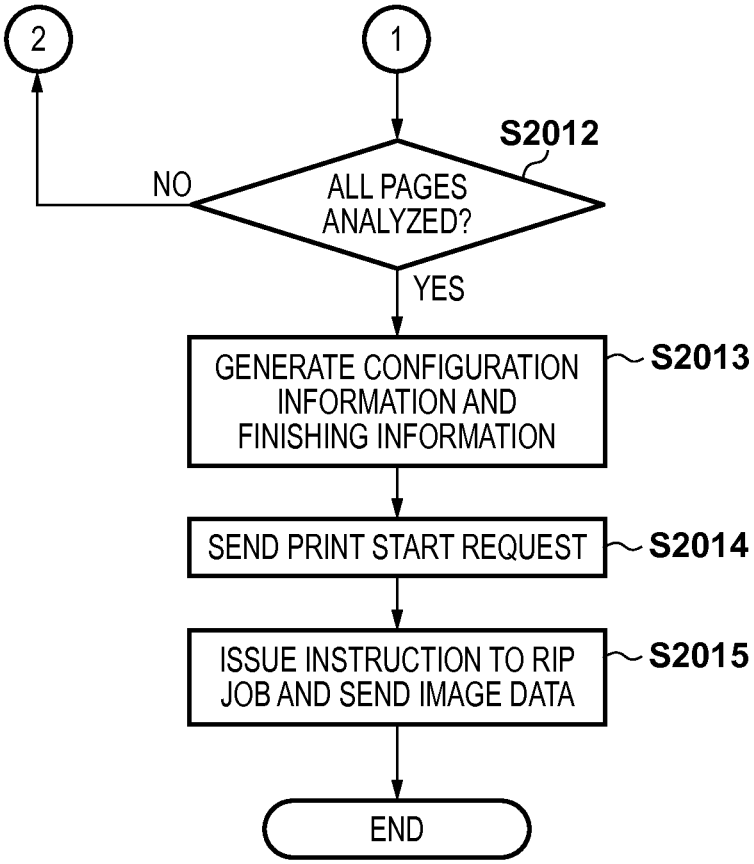
Figure 16:
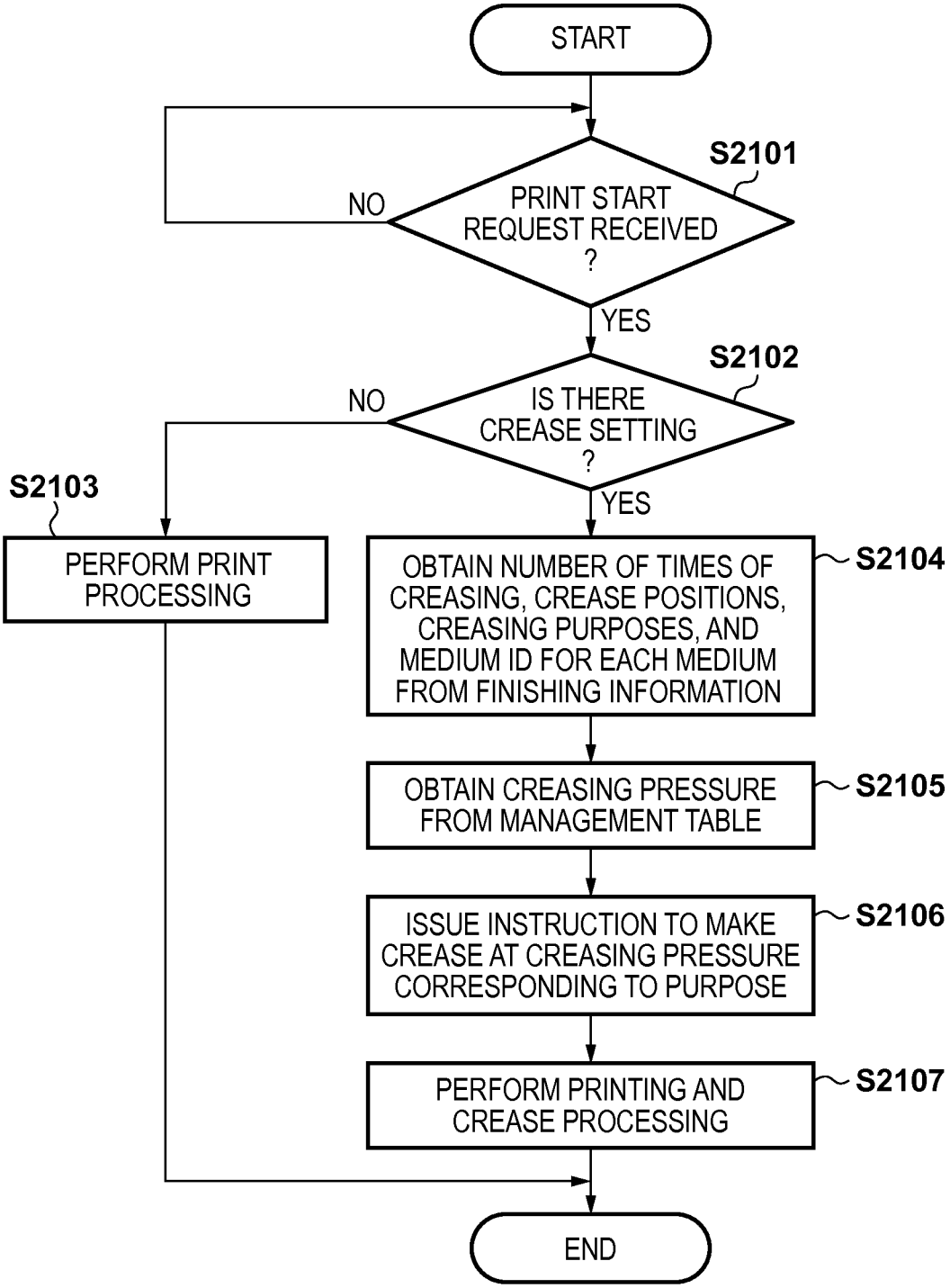
FIG. 16 is a flowchart showing processing by an image forming apparatus according to the second embodiment.

The second embodiment will be explained with reference to the flowcharts of FIGS. 15 and 16. FIGS. 15A and 15B are flowcharts showing processing to be executed by a job control unit 1307 of the image processing apparatus 102. A program regarding this processing is stored in a ROM 1207 of the image processing apparatus 102, and read out and executed by a CPU 1201. FIG. 16 is a flowchart showing processing to be executed by a device control unit 1302 of an image forming apparatus 101. A program regarding this processing is stored in a ROM 1003 of the image forming apparatus 101, and read out and executed by a CPU 1002.

First, as in the first embodiment, when the operator presses the print button 1904 in the information processing apparatus 103, a UI processing unit 1312 requests a job generation unit 1313 to generate a job. In response to this request, the job generation unit 1313 generates a print job. Assume that the job generation unit 1313 has sent the generated job to the job control unit 1307 of the image processing apparatus 102 via a send processing unit 1314.

(Processing in Image Processing Apparatus)

Subsequently, processing by the job control unit 1307 of the image processing apparatus 102 will be explained with reference to FIGS. 15A and 15B. When the process starts, the job control unit 1307 determines in step S2001 whether it has received a print job from the job generation unit 1313 of the information processing apparatus 103. If the job control unit 1307 has received a print job (YES in step S2001), it advances to step S2002. If the job control unit 1307 has not received a print job (NO in step S2001), it waits until it receives a print job.

In step S2002, the job control unit 1307 analyzes job setting information of the received print job, and determines whether a crease setting for each page has been made. More specifically, the job control unit 1307 makes this determination based on whether a setting is made in the crease setting 1903 for each page shown in FIG. 14. If a crease setting for each page has been made (YES in step S2002), the job control unit 1307 advances to step S2006. If a crease setting for each page has not been made (NO in step S2002), the job control unit 1307 advances to step S2003. Steps S2003 to S2005 are the same as those in steps S1703 to S1705 in FIG. 17, and a description thereof will not be repeated.

In step S2006, the job control unit 1307 analyzes the job setting information of the received print job, and determines single- or double-sided printing. More specifically, the job control unit 1307 makes this determination based on settings in a discharge destination setting 1420 shown in FIG. 9C, and printing method settings 1414, 1416, and 1418 shown in FIG. 9B. If the job setting information represents single-sided printing (YES in step S2006), the job control unit 1307 advances to step S2007. If the job setting information represents double-sided printing (NO in step S2006), the job control unit 1307 advances to step S2008. Since a stacking tray 914 is set in the discharge destination setting 1420, the setting in the printing method setting 1418 is referred to, and it is assumed to determine that the job setting information represents single-sided printing.

In step S2007, the job control unit 1307 refers to a medium type setting 1408 shown in FIG. 9A and the crease setting 1903 for each page shown in FIG. 14. First, the job control unit 1307 inquires, of the device control unit 1302 of the image forming apparatus 101, the medium ID of a medium type set in the medium type setting 1408. In the second embodiment, "plain paper 1" is set in the medium type setting 1408, so a medium ID "3" is obtained based on a management table 1600 shown in FIG. 11. Further, the job control unit 1307 reads out settings for one page from settings in the crease setting 1903 for each page, and extracts the number of times of creasing, crease positions, and creasing purposes. After that, the job control unit 1307 advances to step S2011.

In step S2008, the job control unit 1307 refers to the medium type setting 1408 shown in FIG. 9A and the crease setting 1903 for each page shown in FIG. 14. First, the job control unit 1307 inquires, of the device control unit 1302, the medium ID of a medium type set in the medium type setting 1408. Then, the job control unit 1307 reads out settings for two pages from settings in the crease setting 1903 for each page, and extracts the number of times of creasing, crease positions, and creasing purposes. After that, the job control unit 1307 advances to step S2009.

In step S2009, the job control unit 1307 determines whether the crease setting is made for the two surfaces. If the crease setting is made for the two surfaces (YES in step S2009), the process advances to step S2010. If the crease setting is not made for the two surfaces (NO in step S2009), the process advances to step S2011.

In step S2010, the job control unit 1307 discards the crease setting made for the back surface, and leaves only the setting of the front surface. The job control unit 1307 then advances to step S2010.

The second embodiment assumes processing of discarding the crease setting of one surface (back surface in this case) to simplify the description. Instead of this processing, the crease settings of the front and back surfaces may be integrated into a crease on one surface. In this case, it is necessary to consider that the references of crease positions on the front and back surfaces are set for each logical page. For example, when the crease position of the back surface is integrated into the crease position of the front surface, it is controlled to set, as a crease position, a length obtained by subtracting the crease position of the back surface from the length of a medium in the conveyance direction in consideration of the medium size setting 1409 and the binding direction setting 1419. Depending on the medium type, even if creases are set for the two surfaces, they may be made without any change. Hence, when creases are set for the two surfaces, it may be determined whether to remove or integrate creases depending on the medium type.

In step S2011, the job control unit 1307 holds, in a RAM 1004, the number of times of creasing, crease positions, creasing purposes, and a medium ID for the nth medium to be printed. In step S2012, the job control unit 1307 checks whether the processes in steps S2006 to S2011 have been completed on all the pages of the print data. If the processes have been completed on all the pages (YES in step S2012), the job control unit 1307 advances to step S2013. If the processes have not been completed on all the pages (NO in step S2012), the job control unit 1307 returns to step S2006 and repeats the processing on an unprocessed page.

In step S2013, the job control unit 1307 generates configuration information based on items set in "medium" and "layout" of the job setting window. At this time, the job control unit 1307 inquires, of the device control unit 1302 of the image forming apparatus 101, the medium ID of a medium type set in the medium type setting 1402 or 1408, and sets the obtained medium ID in the configuration information. Also, the job control unit 1307 generates finishing information based on items set in "finishing" and "crease" of the job setting window. At this time, the job control unit 1307 sets, in the finishing information, even association information of the crease position and creasing purpose that has been generated in step S2011.

In step S2014, the job control unit 1307 sends a print start request to the device control unit 1302 of the image forming apparatus 101. Together with this request, the job control unit 1307 sends the configuration information and finishing information generated in step S2013. In step S2015, the job control unit 1307 instructs a RIP processing unit 1308 to send RIPed image data of the print job to the device control unit 1302 of the image forming apparatus 101. Then, the job control unit 1307 ends this processing sequence.

(Processing in Image Forming Apparatus)

Next, processing in FIG. 16 will be explained. When the process starts, the device control unit 1302 determines in step S2101 whether it has received a print start request from the job control unit 1307 of the image processing apparatus 102. If the device control unit 1302 has received a print start request for a print job (YES in step S2101), it advances to step S2102. If the device control unit 1302 has not received a print start request (NO in step S2101), it waits until it receives a print start request.

In step S2102, the device control unit 1302 analyzes finishing information of the received print job, and determines whether crease processing has been set. If crease processing has been set (YES in step S2102), the device control unit 1302 advances to step S2104. If no crease processing has been set (NO in step S2102), the device control unit 1302 advances to step S2103.

In step S2103, the device control unit 1302 performs print processing by the image forming apparatus 101 based on the received configuration information and finishing information. Upon completion of print processing, the device control unit 1302 ends this processing sequence.

In step S2104, the device control unit 1302 analyzes the finishing information of the received print request, and obtains the number of times of creasing, crease positions, creasing purposes, and a medium ID for each medium. In this case, a setting of making, on the first medium, "creases for hinges" at positions of 200 mm and 240 mm from the leading end of a sheet, and "creases for spine edges (creases for folds)" at positions of 210 mm and 230 mm is obtained. In addition, a medium ID "3" is obtained.

In step S2105, the device control unit 1302 obtains, from the creasing pressure management table 1600 shown in FIG. 11 that is saved in an HDD 1016, a "creasing pressure for a hinge" and a "creasing pressure for a spine edge" for all medium IDs obtained in step S2104. Since the medium ID is "3" in this case, "120 Kgf" is obtained as the creasing pressure for a hinge, and "80 Kgf" is obtained as the creasing pressure for a spine edge.

In step S2106, the device control unit 1302 instructs a CPU circuit unit 1101 of a creaser apparatus 205 via a CPU circuit unit 1001 of the image forming apparatus 101 about crease processing on the medium. At this time, the device control unit 1302 issues an instruction to perform creasing based on the settings obtained in step S2104. In this case, the device control unit 1302 issues an instruction to make creases at positions of 200 mm and 240 mm from the leading end of a sheet at a pressure of 120 Kfg and creases at positions of 210 mm and 230 mm at a pressure of 80 Kfg.

In step S2107, the device control unit 1302 uses the CPU circuit unit 1001 of the image forming apparatus 101 to execute printing and execute crease processing on the first medium. Further, the device control unit 1302 executes discharge to the stacking tray 914 of the finisher apparatus 208. The device control unit 1302 then ends this processing sequence.

As described above, creases can be made on one medium at a plurality of creasing pressures in accordance with creasing purposes. In this embodiment, creases can be made on an arbitrary medium constituting a case-bound product at an arbitrary page desired by the operator at a plurality of creasing pressures in accordance with creasing purposes based on crease settings for each page.

This embodiment has described an example in which no crease for a hinge is applied to a cover at the time of bookbinding. When a crease for a hinge is applied, the same processing as that in the first embodiment may be executed additionally.

Third Embodiment

The third embodiment will exemplify a case in which a creaser apparatus 205 of an image forming apparatus 101 includes only one pressure device. The third embodiment will describe an example in which the creasing pressure is controlled by changing a creasing die 604. In the third embodiment, there are a plurality of types of creasing dies. Each creasing die is associated with an ID (identification information), and the creaser apparatus 205 can read the ID of the creasing die. The creasing die controls a creasing pressure with respect to a medium by a spring incorporated in the die. In this embodiment, a die for the "creasing pressure of 100 Kgf" is associated with a die ID "1", and a die for the "creasing pressure of 140 Kgf" is associated with a die ID "2".

Since the premise of the third embodiment is the same as that of the first embodiment, a description of a repetitive part will be omitted, and settings and processing unique to the third embodiment will be explained with reference to FIGS. 17 to 19.

Figure 17:
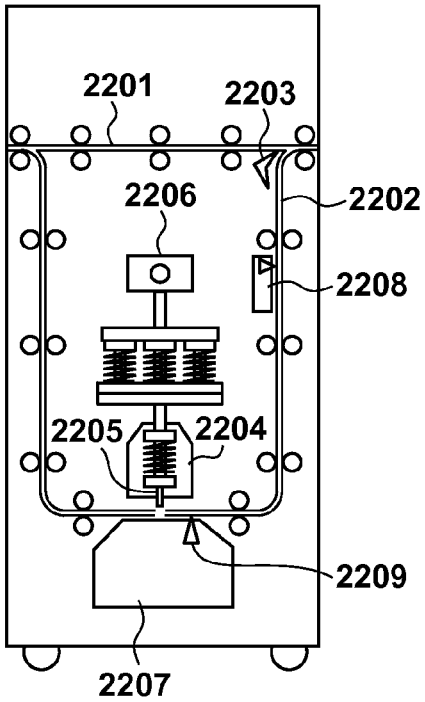
FIG. 17 is a sectional view showing a creaser apparatus according to the third embodiment.

FIG. 17 is a sectional view showing the creaser apparatus 205 according to the third embodiment. Compared with FIG. 4, the three pressure devices 606 to 608 exist in the first embodiment, whereas only a pressure device 2206 exists in the third embodiment. The remaining arrangement is the same as that in FIG. 4, and a description thereof will not be repeated.

Figure 18A:
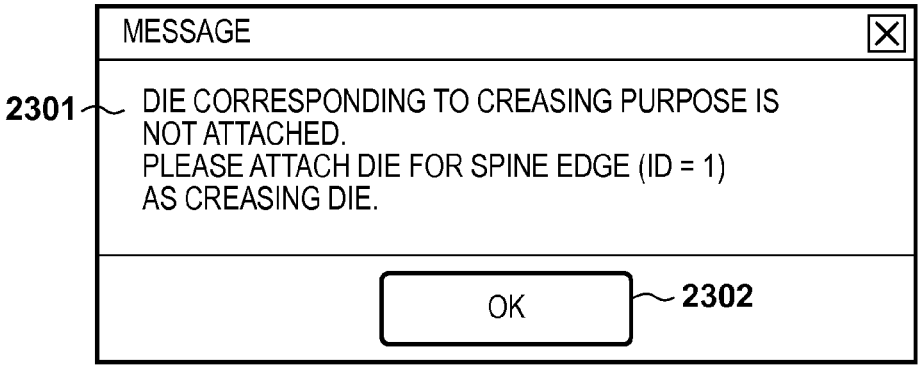
FIGS. 18A and 18B are views each showing an example of a display message according to the third embodiment.
Figure 18B:
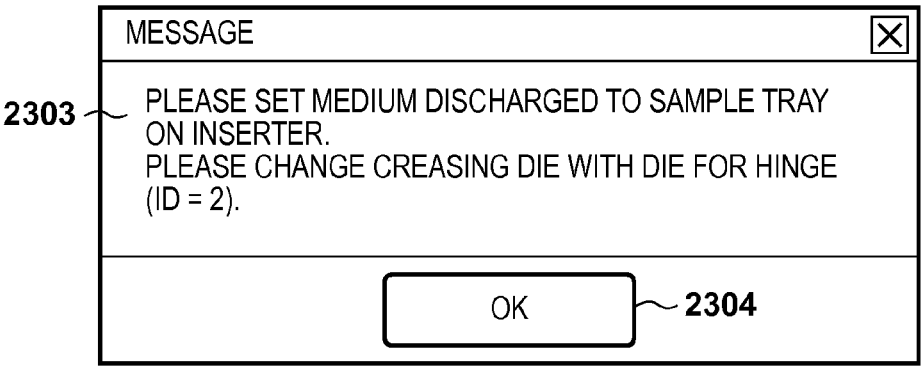

FIGS. 18A and 18B show message windows displayed on an operation panel 425 of the image forming apparatus 101. FIG. 18A shows a message displayed when a creasing die corresponding to a creasing purpose has not been attached in the creaser apparatus 205. As an example of a message 2301, a message that a creasing die (ID=1) for a spine edge has not been attached is displayed. An OK button 2302 is a button that is pressed by the operator after confirming the message 2301. When the operator presses the OK button 2302, the message in FIG. 18A disappears.

FIG. 18B shows a message displayed to prompt the operator to feed a medium to an inserter apparatus 204 and change a die attached in the creaser apparatus 205. As an example of a message 2303, a message to change the die with a creasing die (ID=2) for a hinge is displayed. An OK button 2304 is a button that is pressed by the operator after confirming the message 2303. When the operator presses the OK button 2304, the message in FIG. 18B disappears. Note that a UI processing unit 1301 of the image forming apparatus 101 controls display/non-display of the windows shown in FIGS. 18A and 18B.

[Processing Sequence]

Figure 19:
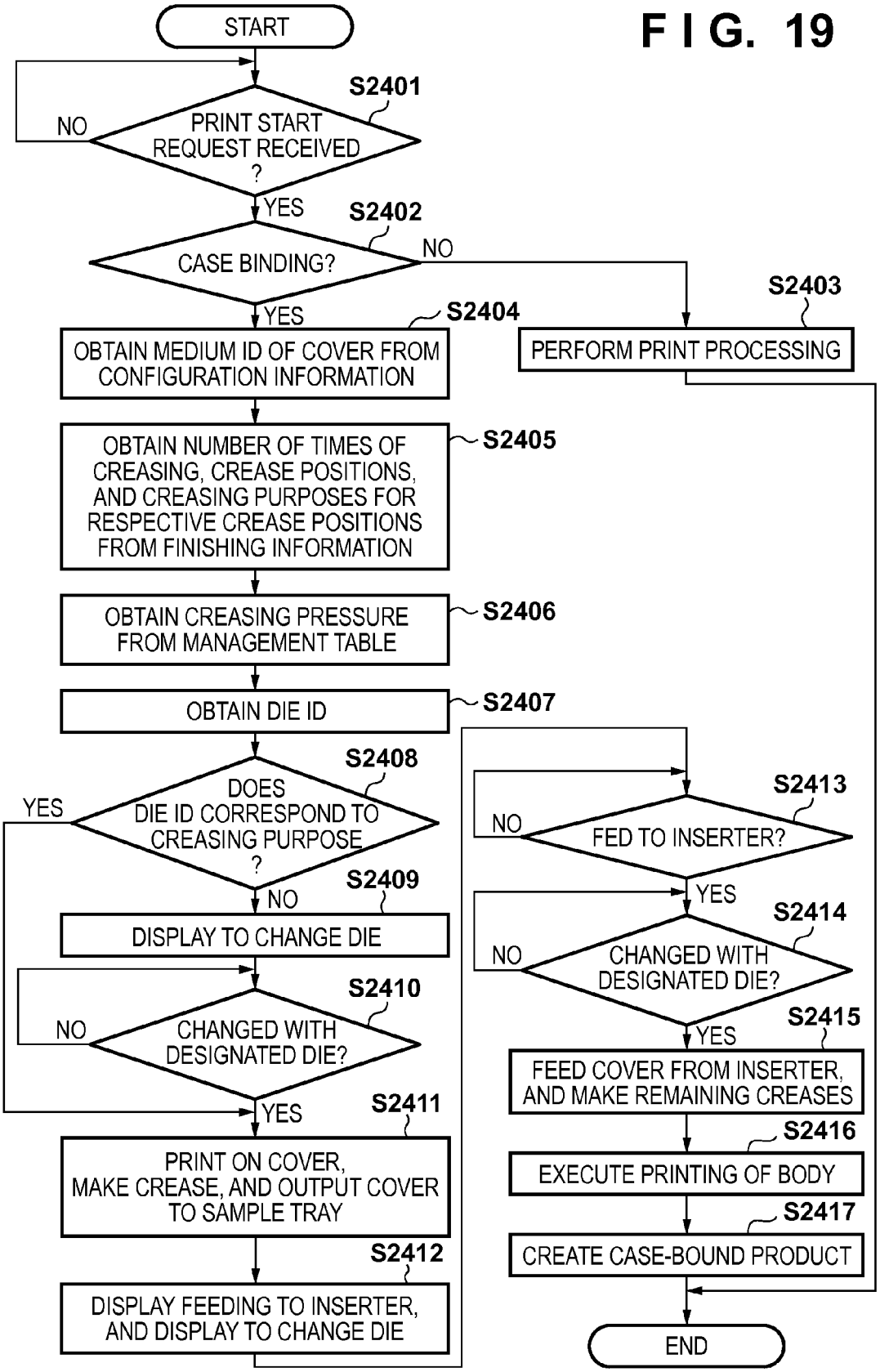
FIG. 19 is a flowchart showing processing by an image forming apparatus according to the third embodiment.

FIG. 19 is a flowchart showing processing to be executed by a device control unit 1302 of the image forming apparatus 101. A program regarding this processing is stored in a ROM 1003 of the image forming apparatus 101, and read out and executed by a CPU 1002. Processes by an information processing apparatus 103 and an image processing apparatus 102 are the same as those in the first embodiment, and a description thereof will not be repeated. Steps S2401 to S2406 are the same as steps S1801 to S1806 of FIG. 13 described in the first embodiment, and a description thereof will not be repeated.

In step S2407, the device control unit 1302 instructs a CPU circuit unit 1101 of the creaser apparatus 205 via a CPU circuit unit 1001 of the image forming apparatus 101 to obtain the ID of an attached creasing die. Upon receiving the instruction, the CPU circuit unit 1101 obtains the ID of the attached creasing die from a die detection unit 1105, and sends it back to the device control unit 1302 via the CPU circuit unit 1001.

In step S2408, the device control unit 1302 checks whether a creasing die for a spine edge has been attached. More specifically, when the medium ID is "1", the creasing pressure for a spine edge is "100 Kgf". Hence, if the ID of the creasing die is "1" (YES in step S2408), the device control unit 1302 advances to step S2411 on the assumption that an appropriate creasing die has been attached. If the ID of the creasing die is not "1" (NO in step S2408), the device control unit 1302 advances to step S2409.

In step S2409, the device control unit 1302 instructs the UI processing unit 1301 to display the message in FIG. 18A. In step S2410, the device control unit 1302 waits until the operator attaches a die for a "crease for a spine edge (crease for a fold)" in the creaser apparatus 205. More specifically, the device control unit 1302 waits until the ID of the creasing die changes to "1". If the ID of the creasing die has changed to "1" (YES in step S2410), the device control unit 1302 determines that the creasing die has been changed with a target one, and advances to step S2411. If the ID of the creasing die has not changed to "1" (NO in step S2410), the device control unit 1302 waits until the creasing die is changed.

In step S2411, the device control unit 1302 executes printing on a case binding cover, further makes a "crease for a spine edge (crease for a fold)", and then discharges the medium to a sample tray 911 of a finisher apparatus 208. In step S2412, the device control unit 1302 instructs the UI processing unit 1301 to display the message in FIG. 18B.

In step S2413, the device control unit 1302 checks whether the medium has been fed to an inserter tray 503 of the inserter apparatus 204. More specifically, the device control unit 1302 obtains a state detected by a sheet detection sensor 504 from a feeder control unit 1010 via the CPU circuit unit 1001 of the image forming apparatus 101, and checks whether the medium has been fed. If the medium has been fed (YES in step S2413), the device control unit 1302 advances to step S2414. If the medium has not been fed (NO in step S2413), the device control unit 1302 waits until the medium is fed.

In step S2414, the device control unit 1302 waits until the operator attaches a die for a "crease for a hinge" in the creaser apparatus 205. More specifically, a target creasing pressure for a hinge when the medium ID is "1" is "140 Kgf". Thus, the device control unit 1302 waits until the ID of the creasing die changes to "2". If the ID of the creasing die has changed to "2" (YES in step S2414), the device control unit 1302 determines that the creasing die has been changed with a target one, and advances to step S2415. If the ID of the creasing die has not changed to "2" (NO in step S2414), the device control unit 1302 waits until the creasing die is changed.

In step S2415, the device control unit 1302 feeds the medium from the inserter tray 503, makes a crease for a hinge, and supplies it to a conveyance path 806 of a case binding apparatus 207. In step S2416, the device control unit 1302 starts printing of print data of a case binding body. The device control unit 1302 supplies the printed medium to a medium stacking unit 810 of the case binding apparatus 207. In step S2417, the device control unit 1302 instructs a case binding control unit 1013 via the CPU circuit unit 1001 of the image forming apparatus 101 to form a case-bound product. Then, the device control unit 1302 ends this processing sequence.

By the above processing, one medium passes twice through the creaser apparatus 205 to make creases at a plurality of creasing pressures in accordance with creasing purposes.

Note that the third embodiment has given an explanation based on the first embodiment, but processing may be executed based on the second embodiment. In the third embodiment, a crease for a hinge is made after making a crease for a spine edge, but the order of making creases may be reversed.

Fourth Embodiment

The fourth embodiment will exemplify a case in which two creaser apparatuses in the third embodiment are connected. The fourth embodiment will exemplify a case in which a creasing die for a "crease for a spine edge (crease for a fold)" and a creasing die for a "crease for a hinge" are attached in the two creaser apparatuses, respectively. In the fourth embodiment, as in the third embodiment, there are a plurality of creasing dies. An ID (identification information) is assigned to each creasing die, and the creaser apparatus can read the ID of the creasing die. The creasing die has a mechanism of controlling a creasing pressure with respect to a medium by a spring incorporated in the die.

As in the third embodiment, the fourth embodiment assumes that a die for the "creasing pressure of 100 Kgf" is associated with a die ID "1", and a die for the "creasing pressure of 140 Kgf" is associated with a die ID "2". Since the premise of the fourth embodiment is the same as that of the first embodiment, a description of a repetitive part will be omitted, and settings and processing unique to the fourth embodiment will be explained with reference to FIGS. 20 to 22.

Figure 20:
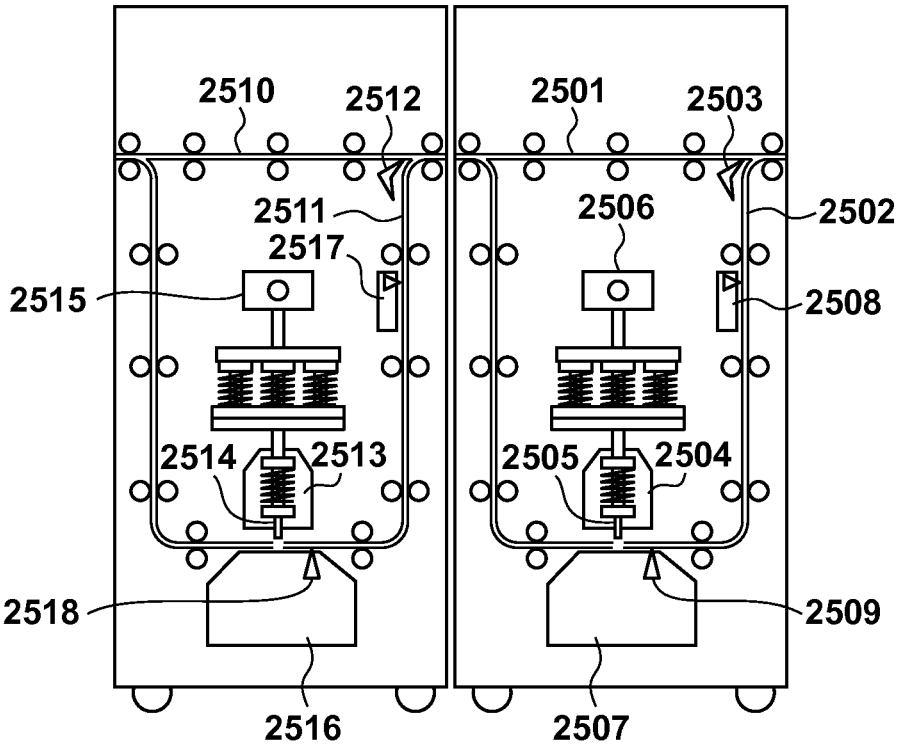
FIG. 20 is a sectional view showing a creaser apparatus according to the fourth embodiment.

FIG. 20 is a sectional view showing a creaser apparatus 205 according to the fourth embodiment. Compared with FIG. 4, two creaser apparatuses in FIG. 17 described in the third embodiment are connected. Pressure devices 2506 and 2515 are operable by controlling corresponding creaser control units 1011 by a CPU circuit unit 1001. In this embodiment, a creaser apparatus that controls the pressure device 2506 includes a CPU circuit unit 1101A, and a creaser apparatus that controls the pressure device 2515 includes a CPU circuit unit 1101B. Assume that creaser control units 1011A and 1011B are connected, instead of the creaser control unit 1011 in FIG. 7A. The remaining arrangement is the same as that in FIG. 17 in the third embodiment, and a description thereof will not be repeated. To simplify the description, a creaser apparatus including the pressure device 2506 will be referred to as creaser A, and a creaser apparatus including the pressure device 2515 will be referred to as creaser B.

Figure 21:
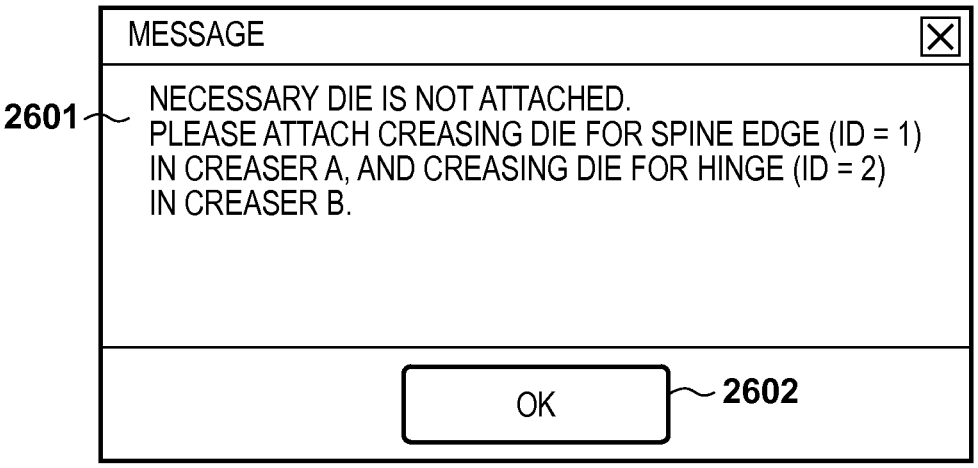
FIG. 21 is a view showing an example of a display message according to the fourth embodiment.

FIG. 21 shows a message window displayed on an operation panel 425 of an image forming apparatus 101. FIG. 21 shows a message displayed when a creasing die corresponding to a creasing purpose has not been attached in the creaser apparatus 205. As an example of a message 2601, a message that neither a creasing die (ID=1) for a spine edge nor a creasing die (ID=2) for a hinge has been attached is displayed. An OK button 2602 is a button that is pressed by the operator after confirming the message 2601. When the operator presses the OK button 2602, the message in FIG. 21 disappears. A UI processing unit 1301 of the image forming apparatus 101 controls display/non-display of the message window in FIG. 21.

[Processing Sequence]

Figure 22:
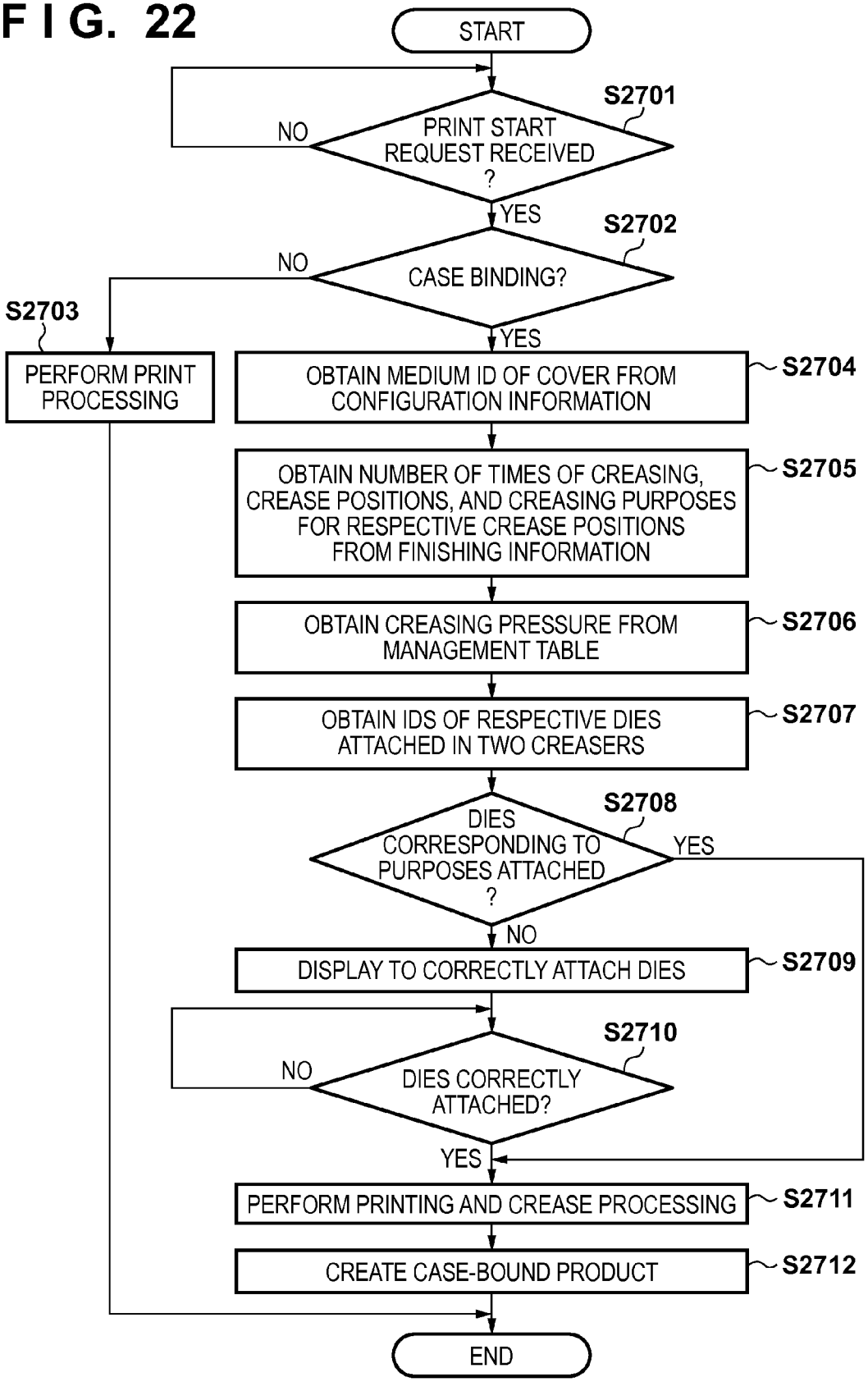
FIG. 22 is a flowchart showing processing by an image forming apparatus according to the fourth embodiment.

FIG. 22 is a flowchart showing processing to be executed by a device control unit 1302 of the image forming apparatus 101. A program regarding this processing is stored in a ROM 1003 of the image forming apparatus 101, and read out and executed by a CPU 1002. Processes by an information processing apparatus 103 and an image processing apparatus 102 are the same as those in the first embodiment, and a description thereof will not be repeated. Steps S2701 to S2706 are the same as steps S1801 to S1806 of FIG. 13 described in the first embodiment, and a description thereof will not be repeated.

In step S2707, the device control unit 1302 issues an instruction via the CPU circuit unit 1001 of the image forming apparatus 101 to obtain the IDs of creasing dies attached in the creaser apparatuses 205. More specifically, the CPU circuit unit 1001 instructs the die detection units of the CPU circuit units 1101A and 1101B to obtain the IDs of attached creasing dies. Upon receiving the instruction, the die detection units of the CPU circuit units 1101A and 1101B send back the obtained IDs of the dies to the device control unit 1302 via the CPU circuit unit 1001.

In step S2708, the device control unit 1302 checks whether a creasing die for a spine edge has been attached in creaser A and a die for a hinge has been attached in creaser B. When the medium ID is "1", the target creasing pressure for a spine edge is "100 Kgf", and the creasing pressure for a hinge is "140 Kgf". More specifically, if the ID of the creasing die of creaser A is "1" and the ID of the creasing die of creaser B is "2" (YES in step S2708), the device control unit 1302 advances to step S2711; otherwise (NO in step S2708), the device control unit 1302 advances to step S2709.

In step S2709, the device control unit 1302 instructs the UI processing unit 1301 to display the message in FIG. 21. In step S2710, the device control unit 1302 waits until the operator attaches creasing dies designed in FIG. 21 to creaser A and creaser B. If the designated creasing dies are attached to creaser A and creaser B (YES in step S2710), the device control unit 1302 advances to step S2711. If the designated creasing dies are not attached to creaser A and creaser B (NO in step S2710), the device control unit 1302 waits until they are attached. Processes in steps S2711 and S2712 are the same those in steps S1808 and S1809 of FIG. 13, and a description thereof will not be repeated.

By the above processing, creases can be made on one medium at a plurality of creasing pressures in accordance with creasing purposes. Note that the fourth embodiment has given an explanation based on the first embodiment, but processing may be executed based on the second embodiment. In the fourth embodiment, the creasing die for a spine edge is attached in creaser A, and the creasing die for a hinge is attached in creaser B, but these creasing dies may be interchanged. Unlike the message display in FIG. 21, even when a creasing die is attached, it may be determined in the processing of step S2710 that the creasing die has been attached correctly.

Although the image forming apparatus 101 and the image processing apparatus 102 are separate in the above-described system, the image processing apparatus 102 may be integrated into the image forming apparatus 101.

Although two types of creases have been exemplified in the above-described example, three or more types of creases may be applied. In this case, it is considered to connect three creaser apparatuses.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034711, filed Feb. 25, 2014, which is hereby incorporated by reference herein in its entirety.

What is claimed is:

1. A printing system comprising:

a printer configured to print images on sheets including a case binding cover sheet and inner sheets;

a creaser arranged on a downstream side of the printer in sheet a conveyance direction and configured to crease a sheet on which an image is printed by the printer;

a case-binder arranged on a downstream side of the creaser in the sheet conveyance direction is configured to glue the inner sheets with the case binding cover sheet, wherein (1) the inner sheets, on which images are printed by the printer and which are conveyed from the printer, are not creased by the creaser, and (2) the case binding cover sheet, on which an image is printed by the printer and which is conveyed from the printer, is creased by the creaser; and a controller configured to control the creaser to crease the case binding cover sheet at a first crease position corresponding to a spine edge of the case binding cover sheet, and to crease the case binding cover sheet at a second crease position corresponding to a hinge of the case binding cover sheet.

2. The printing system according to claim 1, wherein the controller is configured to control the creaser to crease at a first pressure at the first crease position and to crease at a second pressure at the second crease position, the second pressure being greater than the first pressure.

3. The system according to claim 2, wherein a value of the first pressure and a value of the second pressure change for each sheet type.

4. The system according to claim 2, wherein the controller is configured to decide a value of the first pressure and a value of the second pressure for each page of a plurality of pages included in a job.

5. The system according to claim 1, further comprising an operation panel, wherein the controller is configured to (i) determine whether a creasing die for the creasing of the case binding cover sheet has been attached to the creaser, and (ii) control the operation panel to display an error if the creasing die has not been attached.

6. The system according to claim 1, wherein the creaser creases the case binding cover at the first crease position in accordance with a first creasing die being attached to the creaser, and the creaser creases the case binding cover at the second crease position in accordance with a second creasing die being attached to the creaser.

7. The system according to claim 1, further comprising:

a discharge roller configured to discharge the case binding cover sheet creased at the first crease position; and an inserter configured to convey the case binding cover sheet discharged by the discharge roller and set in the inserter, wherein the controller controls the creaser to crease the case binding cover sheet conveyed by the inserter at the second crease position.

8. A printing apparatus comprising:

a printer configured to print images on sheets including a case binding cover sheet and inner sheets;

a creasing controller configured to control a creaser to crease a sheet on which an image is printed by the printer; and a case-binding controller configured to control a case binder to glue the inner sheets with the case binding cover sheet, wherein (1) the inner sheets, on which images are printed by the printer and which are conveyed from the printer, are not creased by the creaser, and (2) the case binding cover sheet, on which an image is printed by the printer and which is conveyed from the printer, is creased by the creaser, wherein the creasing controller is configured to control the creaser to crease the case binding cover sheet at a first crease position corresponding to a spine edge of the case binding cover sheet, and to crease the case binding cover sheet at a second crease position corresponding to a hinge of the case binding cover sheet, and wherein the creaser is arranged on a downstream side of the printer in a sheet conveyance direction, and the case binder is arranged on a downstream side of the creaser in the sheet conveyance direction.

* * * * *